US011584898B2

(12) United States Patent
Bai et al.

(10) Patent No.: US 11,584,898 B2
(45) Date of Patent: Feb. 21, 2023

(54) POLYMERIC SURFACTANTS FOR IMPROVED EMULSION AND FLOW PROPERTIES AT LOW TEMPERATURES

(71) Applicant: Afton Chemical Corporation, Richmond, VA (US)

(72) Inventors: Yunhai Bai, Richmond, VA (US); Joseph Remias, Glen Allen, VA (US); Yen Tran, Richmond, VA (US); Amy M. James, Richmond, VA (US); Kristi Engelman, Richmond, VA (US)

(73) Assignee: Afton Chemical Corporation, Richmond, VA (US)

( * ) Notice: Subject to any disclaimer, the term of this patent is extended or adjusted under 35 U.S.C. 154(b) by 0 days.

(21) Appl. No.: 17/072,705

(22) Filed: Oct. 16, 2020

(65) Prior Publication Data

US 2022/0049180 A1 Feb. 17, 2022

Related U.S. Application Data

(60) Provisional application No. 63/064,777, filed on Aug. 12, 2020.

(51) Int. Cl.

| | |
|---|---|
| ***C10M 173/02*** | (2006.01) |
| ***C10M 149/10*** | (2006.01) |
| ***C10M 169/04*** | (2006.01) |
| *C10N 30/00* | (2006.01) |
| *C10N 50/00* | (2006.01) |
| *C10N 40/25* | (2006.01) |

(52) U.S. Cl.

CPC ..... *C10M 173/02* (2013.01); *C10M 149/10* (2013.01); *C10M 169/041* (2013.01); *C10M 2203/003* (2013.01); *C10M 2217/028* (2013.01); *C10N 2030/24* (2020.05); *C10N 2040/25* (2013.01); *C10N 2050/013* (2020.05)

(58) Field of Classification Search

None

See application file for complete search history.

(56) References Cited

U.S. PATENT DOCUMENTS 4,506,051 A 3/1985 Rance
5,110,853 A 5/1992 Van-Det et al.
(Continued)

FOREIGN PATENT DOCUMENTS

WO 2011015844 A1 2/2011

OTHER PUBLICATIONS

Extended European Search Report for corresponding European Patent Application No. 20207933.1, dated Apr. 20, 2021, 8 pages.
(Continued)

*Primary Examiner* — Vishal V Vasisth
(74) *Attorney, Agent, or Firm* — Honigman LLP

(57) ABSTRACT

A polymer surfactant for improving engine oil emulsion properties of a lubricating composition mixed with water and/or fuel contamination, particularly at very cold temperatures, is described herein. In approaches, selected polymeric and functionalized compounds can impart both robust emulsion properties and simultaneously deliver good low temperature fluidity for lubricating compositions that may contain residual amounts of water and/or fuel contamination. Lubricating compositions including such surfactants demonstrate robust properties at temperatures down to about −30° C.

10 Claims, 4 Drawing Sheets

(56) References Cited

U.S. PATENT DOCUMENTS

| | | | | |
|---|---|---|---|---|
| 5,200,448 | A | 4/1993 | Robinson et al. | |
| 6,204,224 | B1 | 3/2001 | Quintero et al. | |
| 2008/0064615 | A1 | 3/2008 | Devlin et al. | |
| 2013/0199482 | A1 | 8/2013 | Langston et al. | |
| 2015/0075061 | A1 | 3/2015 | Patel et al. | |
| 2015/0133352 | A1* | 5/2015 | Esche | C10M 107/00 508/294 |
| 2019/0218472 | A1 | 7/2019 | Yeung et al. | |

OTHER PUBLICATIONS

European Patent Office, Extended EP Search Report for Application No. 20207933.1, dated Apr. 20, 2021, 8 pages.

* cited by examiner

POLYMERIC SURFACTANTS FOR IMPROVED EMULSION AND FLOW PROPERTIES AT LOW TEMPERATURES

CROSS REFERENCE TO RELATED APPLICATION

The present application claims priority to U.S. Provisional Application No. 63/064,777 filed on Aug. 12, 2020, which is incorporated herein by reference in its entirety.

TECHNICAL FIELD

The present disclosure relates to polymeric surfactants and lubricants including such surfactants that provide improved emulsion and flow properties at low temperatures, such as temperatures down to about −30° C.

BACKGROUND

In certain operating conditions, water and fuel can accumulate in a lubricating composition, such as in lubricants within an engine oil sump. In cold environmental conditions, this residual contamination can pose challenges for efficient engine operation. For instance, a frozen water phase or emulsion of oil, water, and fuel with high viscosity can reduce proper engine lubrication, and in some extreme circumstances, result in engine damage. Problems may occur due to frozen or high viscosity lubricating fluids that could hinder oil suction by an engine oil pump through an oil pick up tube.

Often during normal engine operations, residual fuel and/or water may accumulate in engine oils in many modern passenger cars. An exemplary mechanism by which water may accumulate in the crankcase is if the driving patterns are such that during operation of the engine, the crankcase does not heat up to 100° C. so that any water present can boil and evaporate. This undesired contamination, while minimal, can be further exasperated in cold, or extreme cold, operating conditions and/or when frequent start/stop cycles are accumulated without allowing the engine to reach normal operating temperature where any residual water and/or fuel will leave the oil sump through evaporation.

A further exemplary mechanism of water contamination may be when the fuel contains an alcohol, such as ethanol. A common ethanol-blended fuel is E85, which is a blend of 85 volume % ethanol and 15 volume % gasoline. Although ethanol will readily dissolve water, water will separate from blends of gasoline and ethanol when the solubility limit in ethanol is reached. The amount of water required for this phase separation varies with temperature. This water-ethanol phase can compete with the blended oil for bonding to the metal engine parts. As a result, the engine will not have enough lubrication which can cause engine damage. Hence, maintaining emulsion stability of alcohol-gasoline mixed fuel with lubricating oil compositions is a primary concern.

This problem can also be particularly challenging in the operation of hybrid vehicles or vehicles having automatic engine stop functionality when the vehicle is at rest. As these types of vehicles become more prominent, it can be expected that the prevalence of water and/or fuel contaminating the oil sump may become more prevalent as well.

When an engine oil, water and fuel are mixed it can generate an emulsion phase. If the emulsion is homogeneous and stable, it can still provide lubrication for engine operations. However, if the emulsion is not stable, it will separate into water and oil phases with water at the bottom of the pan.

When the water alone is pumped into the engine, it cannot provide enough lubrication for engine operation and can lead to engine problems. Furthermore, if the car is stored in a very low temperature environment, the water phase or emulsion can freeze or become viscous and starting the car in such instances can risk engine damage due to oil starvation.

SUMMARY AND TERMS

Figure 1:
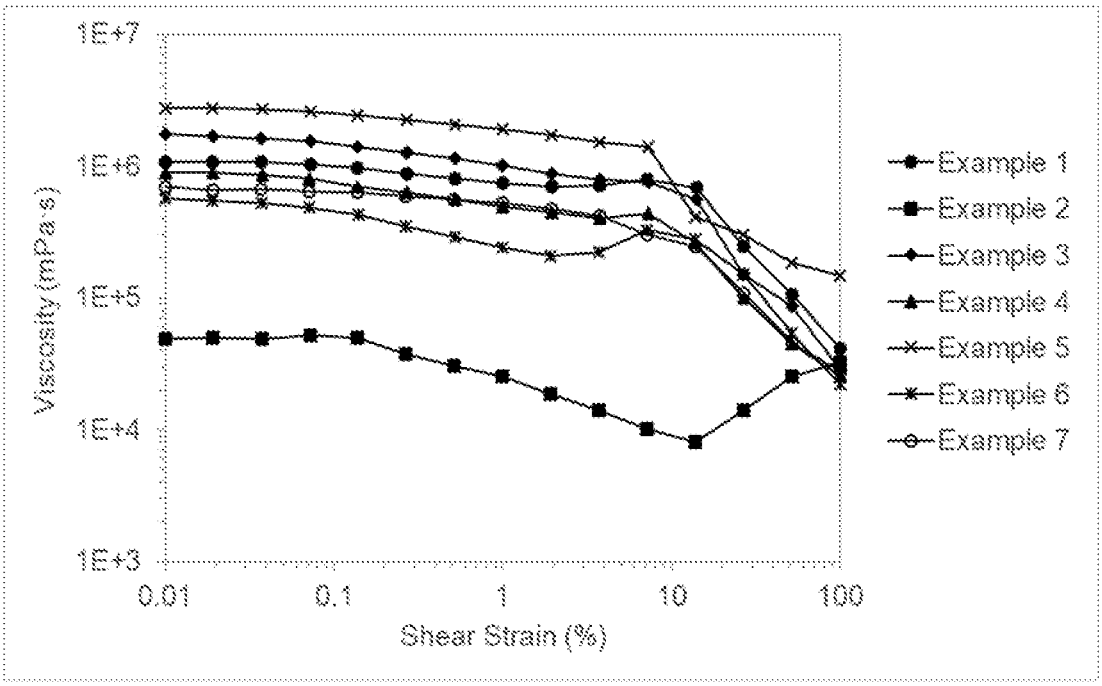
FIG. 1 is a graph of viscosity of emulsions at −30° C., wherein the emulsion is generated by mixing lubricating compositions with fuel and water (the emulsions have been stored at room temperature for 3 hours prior to the measurements)
Figure 2:
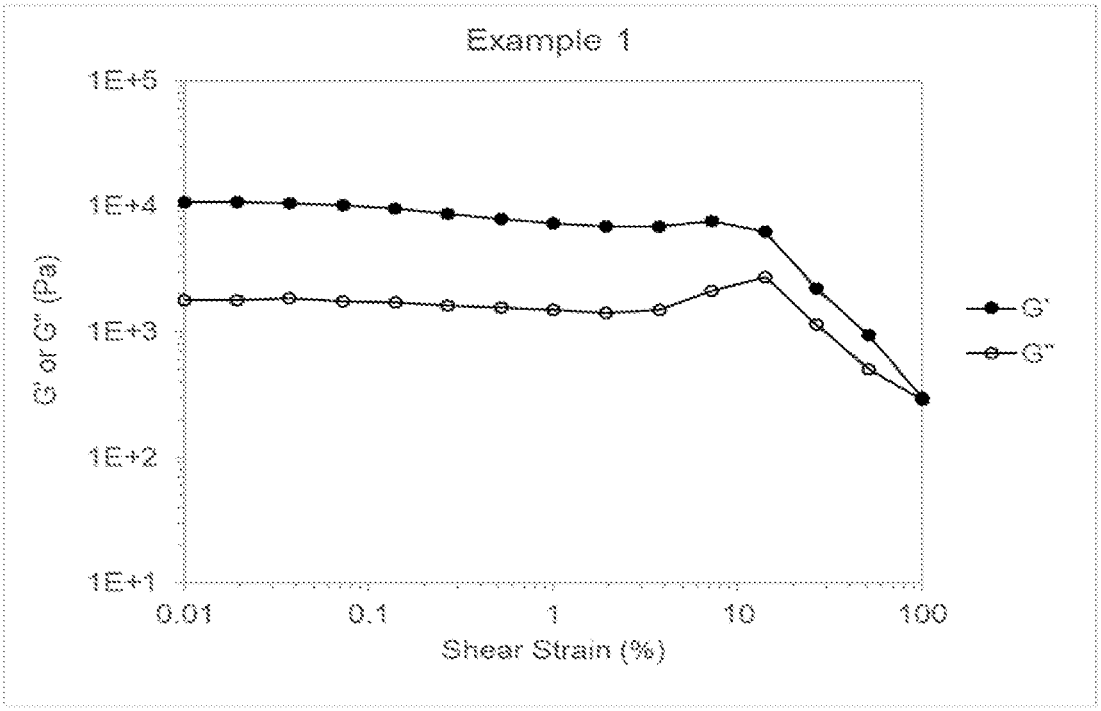
FIGS. 2 to 8 are graphs of strain sweep showing storage modulus (G') and loss modulus (G") of emulsions at −30° C., wherein the emulsion is generated by mixing lubricating compositions with water and fuel (the emulsions have been stored at room temperature for 3 hours prior to the measurements).
Figure 3:
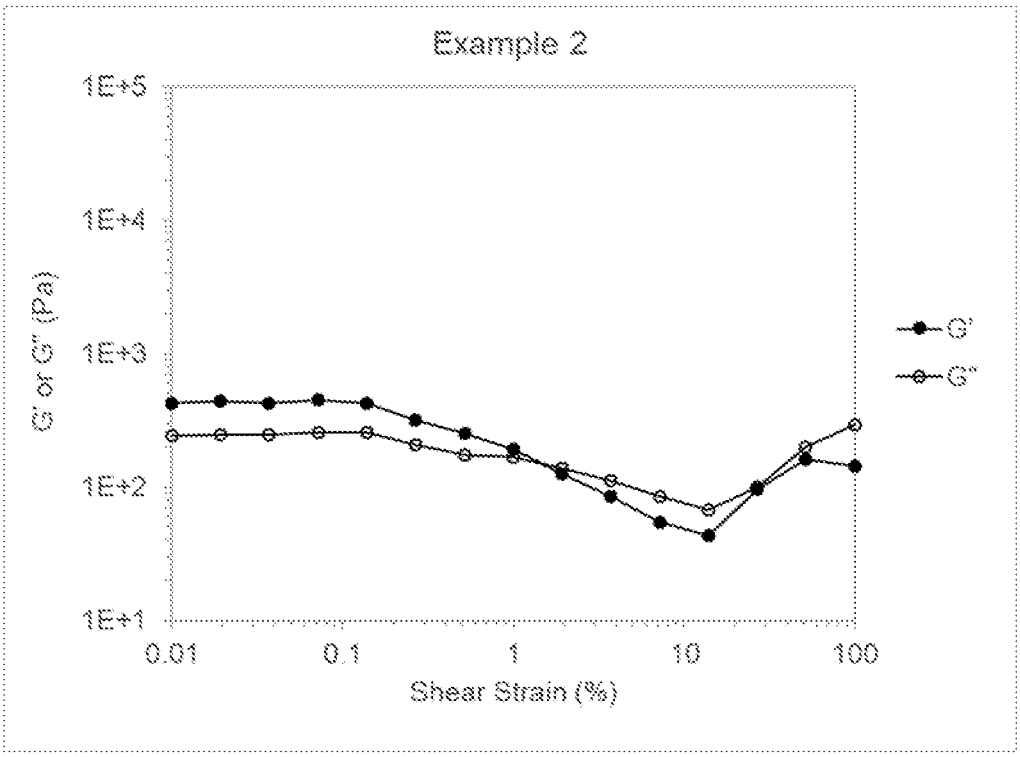
Figure 4:
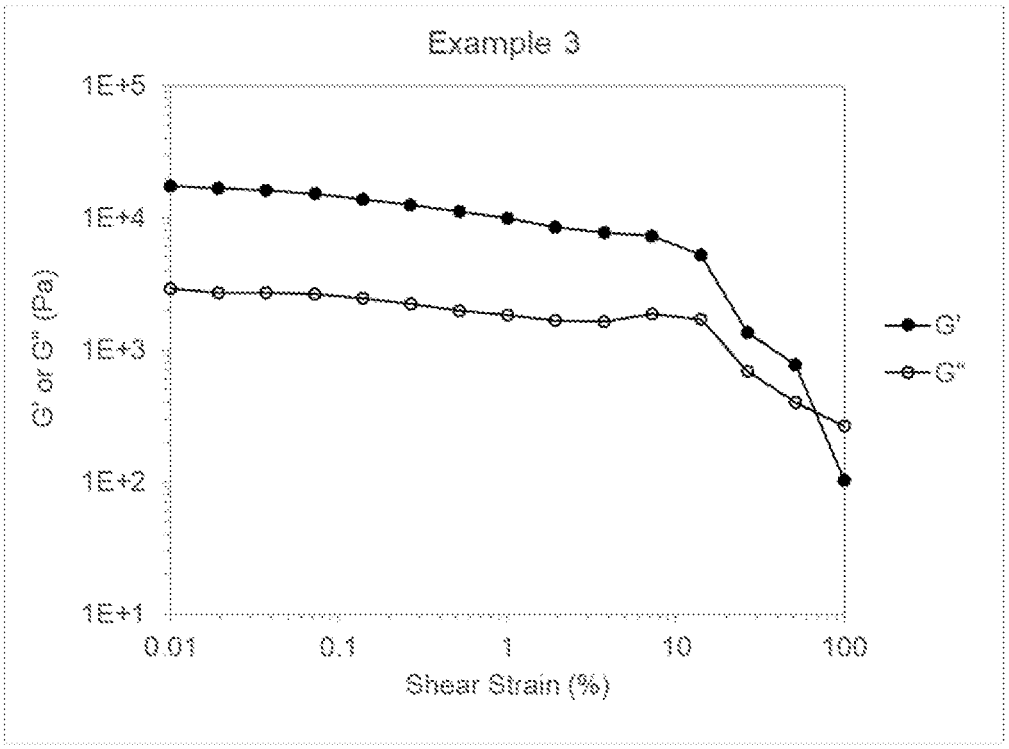
Figure 5:
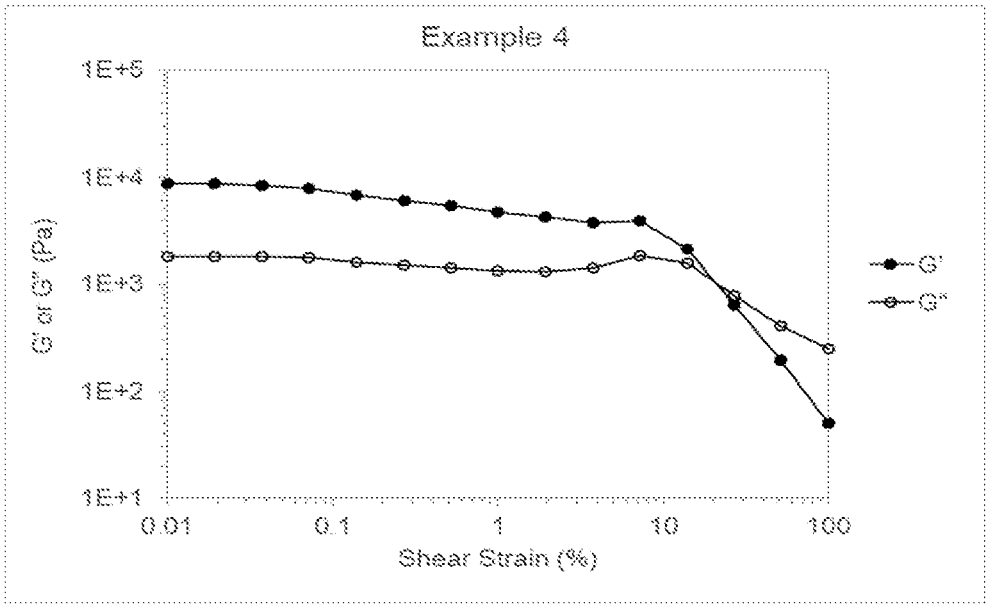
Figure 6:
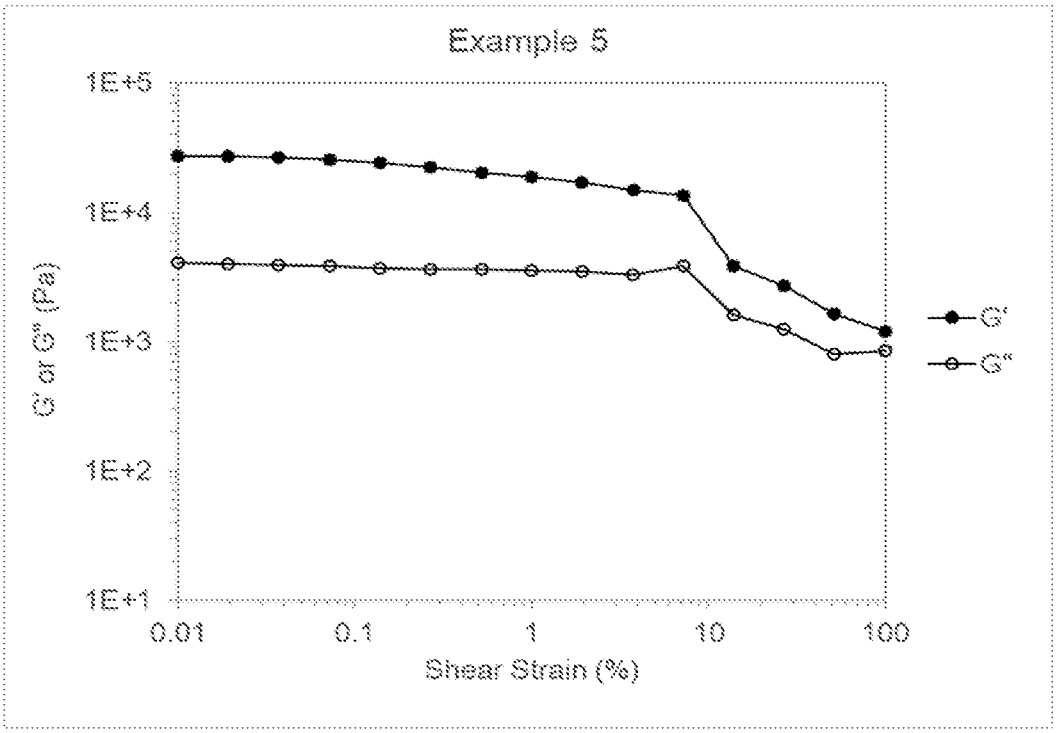
Figure 7:
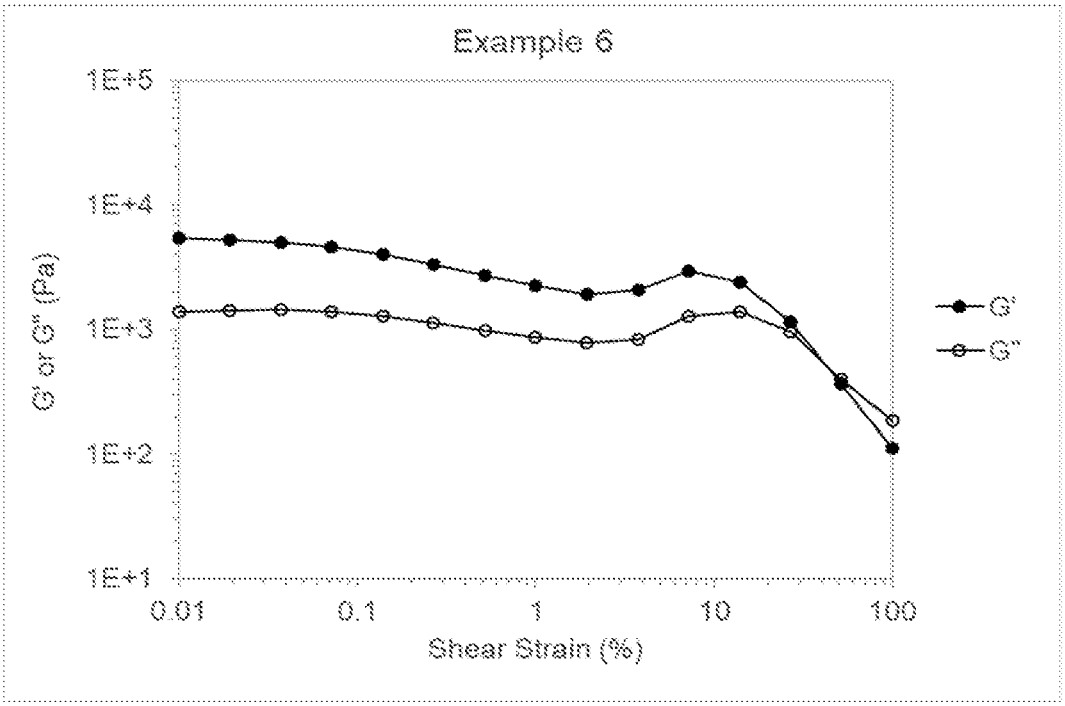
Figure 8:
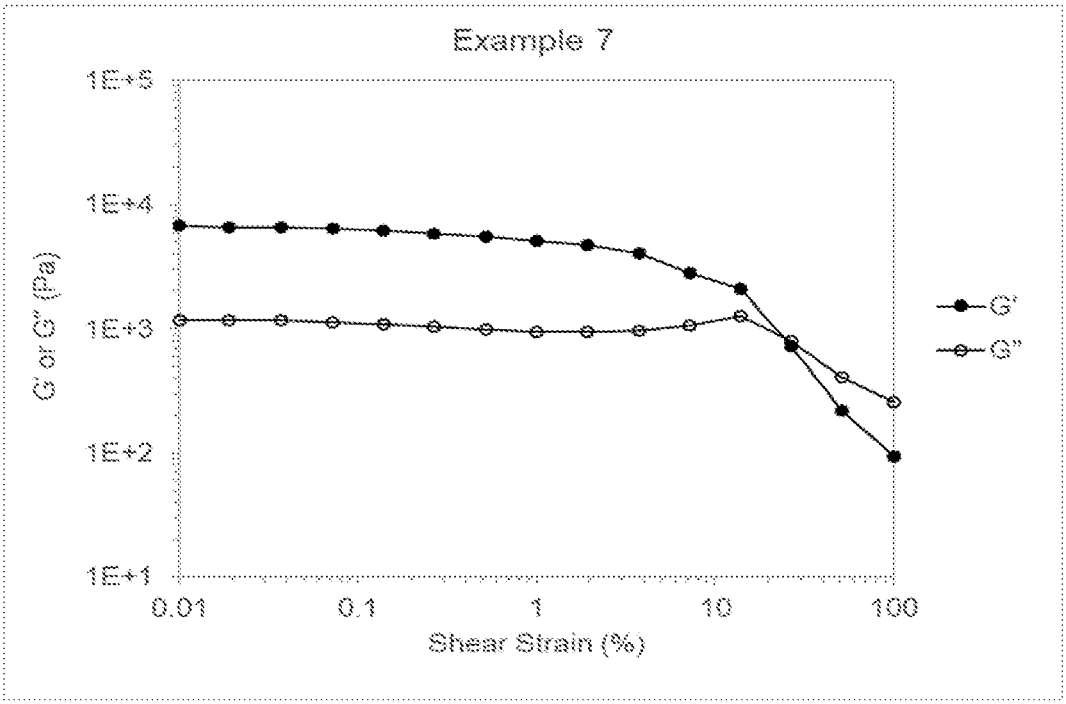

In one approach or embodiment, a polymer surfactant for improving engine oil emulsion properties of an oil:water: fuel system, particularly at very cold temperatures, is described herein.

In approaches, selected polymeric and functionalized compounds can impart both robust emulsion properties and simultaneously deliver good low temperature fluidity for lubricating compositions that may contain residual amounts of water and/or fuel contamination. Lubricating compositions including such surfactants demonstrate robust properties at temperatures down to about −30° C.

In other approaches or embodiments, a low-temperature stable lubricating composition is described herein. The composition includes a base oil of lubricating viscosity, a polymeric surfactant with non-polar moieties and polar functional groups effective to maintain a fluid emulsion as evidenced by a measured flow point of about 75% or less at lubricant temperatures down to about −30° C.; and water and/or fuel contamination. Flow point is further discussed in the Examples below and is the shear strain where G' (storage modulus) equals G" (loss modulus).

In other embodiments, the polymeric surfactant or the lubricating composition described in either of the three prior paragraphs may further include one or more optional features in any combination. These optional features may include: wherein the polymeric surfactant is a copolymer obtained from reactants having ethylenic unsaturation and being functionalized either through grafting of polar groups or by incorporation of polar co-reactants in the polymerization; and/or wherein the polymeric surfactant is a copolymer obtained from reactants including alkyl (meth)acrylate(s) and heterocyclic reactant(s) having a polymerizable ethylenically unsaturated substituent; and/or wherein the heterocyclic reactant(s) having a polymerizable ethylenically unsaturated substituent includes vinyl lactones, vinyl lactams, combinations thereof, and derivatives thereof; and/or wherein the heterocyclic reactant(s) having a polymerizable ethylenically unsaturated substituent include vinyl pyrrolidone, vinyl pyridine, combinations thereof, and derivatives thereof; and/or wherein the alkyl (meth)acrylate reactant includes reactants selected from C1 to C20 linear or branched alkyl (meth)acrylate reactants; and/or wherein a weight average molecular weight of the polymeric surfactant is about 40,000 or greater; and/or wherein the polymeric surfactant has a weight average molecular weight about 800,000 or less; and/or wherein the lubricating composition includes about 0.01 to about 3 weight percent of the polymeric surfactant, preferably less than about 1 weight percent, and more preferably less than about 0.5 weight percent of the polymeric surfactant; and/or wherein the fuel is gasoline; and/or wherein the polar functional groups are pendant to a non-polar polymeric backbone; and/or wherein the polar functional groups of the polymeric surfactant include one or more of oxygen, nitrogen, sulfur, or phosphorus atoms; and/or wherein the lubricating composition is emulsified with water and fuel to generate a fluid emulsion at temperatures down to about −30° C.; and/or wherein the lubricating composition is an engine oil; and/or wherein the lubricating composition is a passenger car motor oil; and/or wherein the fuel is selected from the group consisting of gasoline, an alcohol-based fuel, and an alcohol-blended fuel; and/or wherein the fuel is an ethanol-blended gasoline; and/or wherein the fuel is selected from the group consisting of E10, E50, E85, and E100 fuel.

In another approach or embodiment, the use of any embodiment of the above described polymeric surfactant (with any optional feature noted above) is provided herein to provide a flowable lubricating composition emulsified with water and/or fuel at temperatures to about −30° C.

In another approach or embodiment, a method of lubricating an engine at low temperatures is described herein. In approaches, the method includes providing a lubricating composition of any preceding embodiment of the prior paragraphs of this Summary and lubricating the engine with the lubricating composition at temperatures to about −30° C.

In embodiments, the method may include adding to a lubricating composition an additive including a polymeric surfactant with non-polar moieties and polar functional groups effective to maintain a fluid emulsion as evidenced by a measured flow point of about 75% or less at lubricant temperatures down to about −30° C. when the lubricating composition is mixed with water and/or fuel contamination; and/or wherein the polymeric surfactant is described in any of previous paragraphs of this Summary.

The following definitions of terms are provided in order to clarify the meanings of certain terms as used herein.

The terms "oil composition," "lubrication composition," "lubricating oil composition," "lubricating oil," "lubricant composition," "lubricating composition," "fully formulated lubricant composition," "lubricant," "crankcase oil," "crankcase lubricant," "engine oil," "engine lubricant," "motor oil," and "motor lubricant" are considered synonymous, fully interchangeable terminology referring to the finished lubrication product comprising a major amount of a base oil plus a minor amount of an additive composition.

As used herein, the terms "additive package," "additive concentrate," "additive composition," "engine oil additive package," "engine oil additive concentrate," "crankcase additive package," "crankcase additive concentrate," "motor oil additive package," "motor oil concentrate," are considered synonymous, fully interchangeable terminology referring the portion of the lubricating oil composition excluding the major amount of base oil stock mixture. The additive package may or may not include the viscosity index improver or pour point depressant.

As used herein, the term "fuel" may include diesel, biodiesel, gasoline (also known as petrol), alcohol-based fuel, alcohol-blended fuel, and mixtures thereof. In particular, an alcohol-blended fuel may include a fuel, such as gasoline, blended with ethanol. A common ethanol-blended fuel is E85, which is a blend of 85 volume % ethanol and 15 volume % gasoline. Other ethanol fuels can comprise, for example 10 volume % ethanol (E10), 50 volume % ethanol (E50), and 100 volume % ethanol (E100). E85, gasoline, and diesel are seasonally adjusted to ensure proper starting and performance in different geographic locations. For example, E85 sold during colder months often contain only 70 volume % ethanol and then 30 volume % petroleum additives to produce the necessary vapor pressure for starting in cold temperatures. During warmer months the petroleum additive content for E85 can often be, for example, 17 volume % to about 20 volume %.

By "ethanol" herein is meant ethyl alcohol, the chemical compound C2H5OH. This can arise in or be provided in many qualities or grades, such a commercial of fuel grade, as well as pure or reagent grade ethanol, and can be derived from any source such as but not limited to petroleum refinery streams, distillation cuts, and bio-derived (e.g. bioethanol such as from corn).

The term "overbased" relates to metal salts, such as metal salts of sulfonates, carboxylates, salicylates, and/or phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, salicylates, and/or phenols.

As used herein, the term "hydrocarbyl substituent" or "hydrocarbyl group" is used in its ordinary sense, which is well-known to those skilled in the art. Specifically, it refers to a group having a carbon atom directly attached to the remainder of the molecule and having a predominantly hydrocarbon character. Each hydrocarbyl group is independently selected from hydrocarbon substituents, and substituted hydrocarbon substituents containing one or more of halo groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents are present for every ten carbon atoms in the hydrocarbyl group.

As used herein, the term "hydrocarbylene substituent" or "hydrocarbylene group" is used in its ordinary sense, which is well-known to those skilled in the art. Specifically, it refers to a group that is directly attached at two locations of the molecule to the remainder of the molecule by a carbon atom and having predominantly hydrocarbon character. Each hydrocarbylene group is independently selected from divalent hydrocarbon substituents, and substituted divalent hydrocarbon substituents containing halo groups, alkyl groups, aryl groups, alkylaryl groups, arylalkyl groups, hydroxyl groups, alkoxy groups, mercapto groups, nitro groups, nitroso groups, amino groups, pyridyl groups, furyl groups, imidazolyl groups, oxygen and nitrogen, and wherein no more than two non-hydrocarbon substituents is present for every ten carbon atoms in the hydrocarbylene group.

As used herein, the term "percent by weight", unless expressly stated otherwise, means the percentage the recited component represents to the weight of the entire composition.

The terms "soluble," "oil-soluble," or "dispersible" used herein may, but does not necessarily, indicate that the compounds or additives are soluble, dissolvable, miscible, or capable of being suspended in the oil in all proportions. The foregoing terms do mean, however, that they are, for instance, soluble, suspendable, dissolvable, or stably dispersible in oil to an extent sufficient to exert their intended effect in the environment in which the oil is employed. Moreover, the additional incorporation of other additives may also permit incorporation of higher levels of a particular additive, if desired.

The term "TBN" as employed herein is used to denote the Total Base Number in mg KOH/g as measured by the method of ASTM D2896 or ASTM D4739 or DIN 51639-1.

The term "alkyl" as employed herein refers to straight, branched, cyclic, and/or substituted saturated chain moieties of from about 1 to about 100 carbon atoms.

The term "alkenyl" as employed herein refers to straight, branched, cyclic, and/or substituted unsaturated chain moieties of from about 3 to about 10 carbon atoms.

The term "aryl" as employed herein refers to single and multi-ring aromatic compounds that may include alkyl, alkenyl, alkylaryl, amino, hydroxyl, alkoxy, halo substituents, and/or heteroatoms including, but not limited to, nitrogen, oxygen, and sulfur.

Lubricants, combinations of components, or individual components of the present description may be suitable for use in various types of internal combustion engines. Suitable engine types may include, but are not limited to heavy duty diesel, passenger car, light duty diesel, medium speed diesel, or marine engines. An internal combustion engine may be a diesel fueled engine, a gasoline fueled engine, a natural gas fueled engine, a bio-fueled engine, a mixed diesel/biofuel fueled engine, a mixed gasoline/biofuel fueled engine, an alcohol fueled engine, a mixed gasoline/alcohol fueled engine, a compressed natural gas (CNG) fueled engine, or mixtures thereof. A diesel engine may be a compression ignited engine. A gasoline engine may be a spark-ignited engine. An internal combustion engine may also be used in combination with an electrical or battery source of power. An engine so configured is commonly known as a hybrid engine. The internal combustion engine may be a 2-stroke, 4-stroke, or rotary engine. Suitable internal combustion engines include marine diesel engines (such as inland marine), aviation piston engines, low-load diesel engines, and motorcycle, automobile, locomotive, and truck engines.

The internal combustion engine may contain components of one or more of an aluminum-alloy, lead, tin, copper, cast iron, magnesium, ceramics, stainless steel, composites, and/or mixtures thereof. The components may be coated, for example, with a diamond-like carbon coating, a lubrited coating, a phosphorus-containing coating, molybdenum-containing coating, a graphite coating, a nano-particle-containing coating, and/or mixtures thereof. The aluminum-alloy may include aluminum silicates, aluminum oxides, or other ceramic materials. In one embodiment the aluminum-alloy is an aluminum-silicate surface. As used herein, the term "aluminum alloy" is intended to be synonymous with "aluminum composite" and to describe a component or surface comprising aluminum and another component intermixed or reacted on a microscopic or nearly microscopic level, regardless of the detailed structure thereof. This would include any conventional alloys with metals other than aluminum as well as composite or alloy-like structures with non-metallic elements or compounds such with ceramic-like materials.

The lubricating oil composition for an internal combustion engine may be suitable for any engine lubricant irrespective of the sulfur, phosphorus, or sulfated ash (ASTM D-874) content. The sulfur content of the engine oil lubricant may be about 1 wt % or less, or about 0.8 wt % or less, or about 0.5 wt % or less, or about 0.3 wt % or less, or about 0.2 wt % or less. In one embodiment the sulfur content may be in the range of about 0.001 wt % to about 0.5 wt %, or about 0.01 wt % to about 0.3 wt %. The phosphorus content may be about 0.2 wt % or less, or about 0.1 wt % or less, or about 0.085 wt % or less, or about 0.08 wt % or less, or even about 0.06 wt % or less, about 0.055 wt % or less, or about 0.05 wt % or less. In one embodiment the phosphorus content may be about 50 ppm to about 1000 ppm, or about 325 ppm to about 850 ppm. The total sulfated ash content may be about 2 wt % or less, or about 1.5 wt % or less, or about 1.1 wt % or less, or about 1 wt % or less, or about 0.8 wt % or less, or about 0.5 wt % or less. In one embodiment the sulfated ash content may be about 0.05 wt % to about 0.9 wt %, or about 0.1 wt % or about 0.2 wt % to about 0.45 wt %. In another embodiment, the sulfur content may be about 0.4 wt % or less, the phosphorus content may be about 0.08 wt % or less, and the sulfated ash is about 1 wt % or less. In yet another embodiment the sulfur content may be about 0.3 wt % or less, the phosphorus content is about 0.05 wt % or less, and the sulfated ash may be about 0.8 wt % or less.

In one embodiment the lubricating oil composition is an engine oil, wherein the lubricating oil composition may have (i) a sulfur content of about 0.5 wt % or less, (ii) a phosphorus content of about 0.1 wt % or less, and (iii) a sulfated ash content of about 1.5 wt % or less.

In one embodiment the lubricating oil composition is suitable for a 2-stroke or a 4-stroke marine diesel internal combustion engine. In one embodiment the marine diesel combustion engine is a 2-stroke engine. In some embodiments, the lubricating oil composition is not suitable for a 2-stroke or a 4-stroke marine diesel internal combustion engine for one or more reasons, including but not limited to, the high sulfur content of fuel used in powering a marine engine and the high TBN required for a marine-suitable engine oil (e.g., above about 40 TBN in a marine-suitable engine oil).

In some embodiments, the lubricating oil composition is suitable for use with engines powered by low sulfur fuels, such as fuels containing about 1 to about 5% sulfur. Highway vehicle fuels contain about 15 ppm sulfur (or about 0.0015% sulfur).

Low speed diesel typically refers to marine engines, medium speed diesel typically refers to locomotives, and high speed diesel typically refers to highway vehicles. The lubricating oil composition may be suitable for only one of these types or all.

Further, lubricants of the present description may be suitable to meet one or more industry specification requirements such as ILSAC GF-3, GF-4, GF-5, GF-6, PC-11, CF, CF-4, CH-4, CK-4, FA-4, CJ-4, CI-4 Plus, CI-4, API SG, SJ, SL, SM, SN, ACEA A1/B1, A2/B2, A3/B3, A3/B4, A5/B5, C1, C2, C3, C4, C5, E4/E6/E7/E9, Euro 5/6, JASO DL-1, Low SAPS, Mid SAPS, or original equipment manufacturer specifications such as Dexos™ 1, Dexos™ 2, MB-Approval 229.1, 229.3, 229.5, 229.51/229.31, 229.52, 229.6, 229.71, 226.5, 226.51, 228.0/.1, 228.2/.3, 228.31, 228.5, 228.51, 228.61, VW 501.01, 502.00, 503.00/503.01, 504.00, 505.00, 505.01, 506.00/506.01, 507.00, 508.00, 509.00, 508.88, 509.99, BMW Longlife-01, Longlife-01 FE, Longlife-04, Longlife-12 FE, Longlife-14 FE+, Longlife-17 FE+, Porsche A40, C30, Peugeot Citroen Automobiles B71 2290, B71 2294, B71 2295, B71 2296, B71 2297, B71 2300, B71 2302, B71 2312, B71 2007, B71 2008, Renault RN0700, RN0710, RN0720, Ford WSS-M2C153-H, WSS-M2C930-A, WSS-M2C945-A, WSS-M2C913A, WSS-M2C913-B, WSS-M2C913-C, WSS-M2C913-D, WSS-M2C948-B, WSS-M2C948-A, GM 6094-M, Chrysler MS-6395, Fiat 9.55535 G1, G2, M2, N1, N2, Z2, S1, S2, S3, S4, T2, DS1, DSX, GH2, GS1, GSX, CR1, Jaguar Land Rover STJLR.03.5003, STJLR.03.5004, STJLR.03.5005, STJLR.03.5006, STJLR.03.5007, STJLR.51.5122 or any past or future PCMO or HDD specifications not mentioned herein. In some embodiments for passenger car motor oil (PCMO) applications, the amount of phosphorus in the finished fluid is 1000 ppm or less or 900 ppm or less or 800 ppm or less.

Other hardware may not be suitable for use with the disclosed lubricant. A "functional fluid" is a term which encompasses a variety of fluids including but not limited to tractor hydraulic fluids, power transmission fluids including automatic transmission fluids, continuously variable transmission fluids and manual transmission fluids, hydraulic fluids, including tractor hydraulic fluids, some gear oils, power steering fluids, fluids used in wind turbines, compressors, some industrial fluids, and fluids related to power train components. It should be noted that within each of these fluids such as, for example, automatic transmission fluids, there are a variety of different types of fluids due to the various transmissions having different designs which have led to the need for fluids of markedly different functional characteristics. This is contrasted by the term "lubricating fluid" which is not used to generate or transfer power.

With respect to tractor hydraulic fluids, for example, these fluids are all-purpose products used for all lubricant applications in a tractor except for lubricating the engine. These lubricating applications may include lubrication of gearboxes, power take-off and clutch(es), rear axles, reduction gears, wet brakes, and hydraulic accessories.

When the functional fluid is an automatic transmission fluid, the automatic transmission fluids must have enough friction for the clutch plates to transfer power. However, the friction coefficient of fluids has a tendency to decline due to the temperature effects as the fluid heats up during operation. It is important that the tractor hydraulic fluid or automatic transmission fluid maintain its high friction coefficient at elevated temperatures, otherwise brake systems or automatic transmissions may fail. This is not a function of an engine oil.

Tractor fluids, and for example Super Tractor Universal Oils (STUOs) or Universal Tractor Transmission Oils (UTTOs), may combine the performance of engine oils with transmissions, differentials, final-drive planetary gears, wet-brakes, and hydraulic performance. While many of the additives used to formulate a UTTO or a STUO fluid are similar in functionality, they may have deleterious effect if not incorporated properly. For example, some anti-wear and extreme pressure additives used in engine oils can be extremely corrosive to the copper components in hydraulic pumps. Detergents and dispersants used for gasoline or diesel engine performance may be detrimental to wet brake performance. Friction modifiers specific to quiet wet brake noise, may lack the thermal stability required for engine oil performance. Each of these fluids, whether functional, tractor, or lubricating, are designed to meet specific and stringent manufacturer requirements.

The present disclosure provides novel lubricating oil blends formulated for use as automotive crankcase lubricants. The present disclosure provides novel lubricating oil blends formulated for use as 2 T and/or 4 T motorcycle crankcase lubricants. Embodiments of the present disclosure may provide lubricating oils suitable for crankcase applications and having improvements in the following characteristics: air entrainment, alcohol fuel compatibility, antioxidancy, antiwear performance, biofuel compatibility, foam reducing properties, friction reduction, fuel economy, pre-ignition prevention, rust inhibition, sludge and/or soot dispersability, piston cleanliness, deposit formation, and water tolerance.

Engine oils of the present disclosure may be formulated by the addition of one or more additives, as described in detail below, to an appropriate base oil formulation. The additives may be combined with a base oil in the form of an additive package (or concentrate) or, alternatively, may be combined individually with a base oil (or a mixture of both). The fully formulated engine oil may exhibit improved performance properties, based on the additives added and their respective proportions.

Additional details and advantages of the disclosure will be set forth in part in the description which follows, and/or may be learned by practice of the disclosure. The details and advantages of the disclosure may be realized and attained by means of the elements and combinations particularly pointed out in the appended claims. It is to be understood that both the foregoing general description and the following detailed description are exemplary and explanatory only and are not restrictive of the disclosure, as claimed.

DETAILED DESCRIPTION

Engine or crankcase lubricant compositions are commonly used in vehicles containing spark ignition and compression ignition engines to provide friction reduction and other benefits. Such engines may be used in automotive, truck, and/or train applications to suggest but a few applications and may be operated on fuels including, but not limited to, gasoline, diesel, alcohol, bio-fuels, compressed natural gas, and the like. These engines may include hybrid-electric engines that include both an internal combustion engine and an electric or battery power source and/or advanced hybrid or internal combustion engines that include an automatic engine stop functionality when a vehicle is at rest.

This disclosure describes polymeric surfactants and lubricating compositions including such surfactants suitable for use as engine lubricants, such as automotive crankcase lubricants that, in some instances, may meet or exceed the ILSAC GF-6 and/or API CK lubricant standards that provide robust functionality at temperatures down to about −30° C. (such as, about 0 to about −30° C.). Other lubricating compositions that may be expected to operate at extreme cold temperatures, such as but not limited to automotive transmissions or gear boxes, industrial or personal machines, metal working, turbines, gear oils, and the like may also benefit from the polymeric surfactants of this disclosure.

In one aspect, the present disclosure provides a polymeric surfactant that can be blended into a finished lubricating compositions at low treat rates, such as treat rates of about 3 weight percent or less, and not only provide improved emulsion stability of a lubricating composition with residual water and/or fuel contamination, but also significantly improve the low temperature properties of the emulsion phase. In particular, the polymers and fluids herein including such polymers can lower the freezing point of the emulsion phase, maintain a fluid viscosity, and/or reduce/prevent the formation of a solid phase at low temperatures down to about −30° C. Therefore, even in winters of very cold regions, the fluids of the present disclosure, even with residual amounts of water and/or fuel contamination, can still be pumped through an engine when a cold engine is started to reduce and prevent potential engine failures.

In some approaches, the polymeric surfactants include copolymers of select non-polar moieties or chains and effective polar functional groups to achieve the benefits of emulsion stability and/or flowable viscosity at such cold temperatures. As used herein, the terms 'non-polar' and 'polar' are used in the ordinary sense and also refer to hydrophobic and hydrophilic groups or moieties, respectively. In approaches, the polar functional groups may include select moieties in or pendant from a polymeric chain and with O-, N-, S-, or P-containing groups and, in yet other approaches and as described further below, can be obtained from amido amines, succinimides, and/or heterocyclic reactant(s) having a polymerizable ethylenically unsaturated substituent such as but not limited to alkylaminopropyl methacrylamide, N-phenyl-phenylenediamine succinimide, N-vinyl pyrrolidone and other lactones and lactams effective to achieve the desired functionality noted herein. In yet other approaches, the non-polar chain or backbone can include mainly polyalkylacrylate moieties, olefin moieties, or polymeric chains of other non-polar monomers. In yet other approaches, the weight percent of the select polar functional groups of the polymeric surfactants herein is low, such as about 30 weight percent or less, of the total polymeric surfactant. Unexpectedly, even with such low polar functionality, it has been discovered that the select polymeric surfactants herein achieve surprising low temperature functionality at minimal treat rates of about 3 weight percent or less in finished lubricating compositions.

As used herein, low temperature flowability is measured by a so-called flow point, which is defined as the shear strain where G' (storage modulus) equals G" (loss modulus) at the temperature of interest, which includes temperatures down to about −30° C. for the compositions herein. A lower measured flow point using the methodology herein suggests a lubricating composition having better flowability at the testing conditions or temperature. Flow points are measured using an Anton Paar Oscillating MCR Rheometer (or equivalent) by performing a strain sweep from 0.01 to 100% shear strain with a parallel plate spindle. Such testing is described in more details below in the Examples. The polymeric surfactants herein can surprisingly improve emulsion low temperature flowability of lubricant and exhibit a flow point at −30° C. of about 75% or below.

Polymeric Surfactant: In one aspect, the polymeric surfactants herein include copolymers having a polymeric chain or backbone with (i) non-polar moieties and (ii) polar functional groups effective to maintain a fluid emulsion as evidenced by a measured flow point of about 75% or less (about 45% or less, about 10% or less, or even about 5% or less or about 1% or greater, about 5% or greater, or about 10% or greater) at lubricant temperatures down to about −30° C. (such as about 0 to about −30° C.) when the lubricating composition includes residual amounts of water and/or fuel contamination. In one approach, the polymeric surfactant is a polymer or copolymer obtained from reactants having, for instance, an ethylenic unsaturation and being functionalized through grafting of polar groups, incorporation of polar reactants/monomers into the polymerization, and/or reactants having polar substitution. In some approaches, the polymeric surfactant is a copolymer obtained from at least reactants including (i) non-polar moieties derived from alkyl (meth)acrylate(s), olefin(s), and the like non-polar reactants and (ii) polar functional groups derived from reactants including one or more of oxygen, nitrogen, sulfur, or phosphorus atom and the like groups. In another approach, the polar functionality or the polar functional groups are derived from heterocyclic reactant(s) having a polymerizable ethylenically unsaturated substituent. In yet other approaches, the polar functionality or functional groups may be derived from amido amines having a polymerizable ethylenically unsaturated substituent or reactants having imide or amide substituents such as succinimide and the like moieties. The polar functional groups of the resultant polymeric surfactant are groups within the polymer chain and/or groups pendant to the polymer chain.

In one approach, the polar functional groups are preferably provided by one or more heterocyclic reactants that also include a polymerizable ethylenically unsaturated substituent. These reactants may be grafted to the main polymeric backbone or may be polymerized within the backbone and provide polar-functional side chains or polar functional pendant groups. In approaches, the polar functional groups may be provided by a polymerizable reactant that includes vinyl lactones, vinyl lactams, combinations thereof, and derivatives thereof and, preferably, may include polymerizable reactants selected from vinyl pyrrolidone, vinyl pyridine, N-vinyl pyrrolidone, N-vinylimidazole, N-vinyl caprolactam, combination thereof, or derivatives thereof.

In other approaches, the polar functional groups may be provided by polymerizable amido amines, such as acrylamide reactants represented by the following Formula:

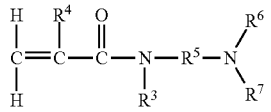

(2)

where $R^4$ is hydrogen or an alkyl group containing from 1 to 4 carbon atoms, $R^3$ is hydrogen, an alkyl or alkenyl group containing from one to thirty carbon atoms, or an aryl group, $R^5$ is an alkylene group, an aralkylene group, a cycloalkylene group, an arylene group, or an alkarylene group, and $R^6$ and $R^7$ are independently selected from hydrogen, a branched or linear alkyl or alkenyl group, an aryl group, an aralkyl group, a cycloalkyl group, or an alkaryl group.

In the above Formula (2), when $R^6$ or $R^7$ is alkyl, each may be methyl, ethyl, n-propyl, isopropyl, n-butyl, isobutyl, sec-butyl, amyl, octyl, decyl, octadecyl and the like. When $R^6$ or $R^7$ is aralkyl, it may be benzyl, betaphenylethyl and the like. When $R^6$ or $R^7$ is cycloalkyl, it may be cyclohexyl, cycloheptyl, cyclooctyl, 2-methylcycloheptyl, 3-butylcyclohexyl, 1,3-methylcyclohexyl, and the like. When $R^6$ or $R^7$ is alkaryl, it may be tolyl, xylyl, and the like. $R^6$ or $R^7$ may be inertly substituted, i.e., it may bear a non-reactive substituent such as alkyl, aryl, cycloalkyl, ether, and the like. Preferred $R^6$ or $R^7$ groups may be lower alkyl, i.e., C1-C10 alkyl groups including e.g., methyl, ethyl, n-propyl, i-propyl, butyl, amyl, hexyl, octyl, decyl, and the like.

As disclosed above, $R^5$ may be selected from an alkylene group, an aralkylene group, a cycloalkylene group, an arylene group, and an alkarylene group. When $R^5$ is an alkylene group, it may be methylene, ethylene, n-propylene, iso-propylene, n-butylene, i-butylene, sec-butylene, octylene, decylene, octadecylene, and the like. When $R^5$ is an aralkylene group, it may be benzylene, beta-phenylethylene, and the like. When $R^5$ is a cycloalkylene group, it may be cyclohexylene, cycloheptylene, cyclooctylene, 2-methylcycloheptylene, 3-butylcyclo-hexylene, 3-methylcyclohexylene, and the like. $R^5$ may also be inertly substituted, i.e., it may bear a non-reactive substituent such as alkyl, aryl, cycloalkyl, ether, and the like. The preferred $R^5$ groups may be lower alkylene, i.e., C1-C10 alkylene, groups including e.g., methylene, ethylene, n-propylene, i-propylene, butylene, amylene, hexylene, octylene, decylene, and the like. $R^5$ is preferably propylene (—$CH_2CH_2CH_2$—). Representative of the compounds of Formula (2) include N,N-dimethylaminopropylmethacrylamide, N,N-diethylaminopropylmethacrylamide and N,N-dimethylaminoethylacrylamide.

In yet another approach, the polar functional groups may be provided by a succinimide. Succinimide formation is well-known in the art and may be accomplished by converting a succinic acid or anhydride, which is subsequently reacted with a nitrogen source, to form an olefin copolymer, i.e., an olefin copolymer succinimide. The acylated copolymer can be made by reacting the double bond on the terminal end group of the copolymer with an acylating agent (e.g., maleic acid or maleic anhydride) via thermal ene reaction and/or halogenation-condensation, see, e.g., U.S. Pat. No. 7,897,696, which is incorporated herein by reference. In an acylated copolymer such as an alkenyl succinic acid or anhydride, the ratio of succinic moiety:copolymer backbone may be about 0.8:1 to about 2:1, or about 1:1 to about 1.8:1, or about 1.2:1 to about 1.5:1. In some approaches, the acylating agent of the above process is an unsaturated substituted or un-substituted organic acid or anhydride, for example maleic or fumaric reactants of the general formula:

(Formula IV)

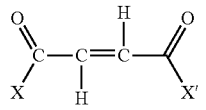

wherein X and X' are the same or different, provided that at least one of X and X' is a group that is capable of reacting to esterify alcohols, forming amides or amine salts with ammonia or amines, forming metal salts with reactive metals or basically reacting metal compounds, or otherwise functioning as an acylating agent. Typically, X and/or X' is —OH, —O-hydrocarbyl, —$NH_2$, and taken together X and X' can be —O— so as to form an anhydride. In some embodiments, X and X' are such that both carboxylic functions can enter into acylation reactions.

Maleic anhydride is a suitable acylating agent that may subsequently formed into the succinimide polar group. Other suitable acylating agents include electron-deficient olefins such as monophenyl maleic anhydride; monomethyl maleic anhydride, dimethyl maleic anhydride, N-phenyl maleimide and other substituted maleimides; isomaleimides; fumaric acid, maleic acid, alkyl hydrogen maleates and fumarates, dialkyl fumarates and maleates, fumaronilic acids and maleanic acids; and maleonitrile and fumaronitrile.

As mentioned above, conversion of the acylated copolymer, such as alkenyl succinic acid or anhydride to a succinimide is well-known in the art and may be accomplished through reacting the acylated copolymer with a nitrogen source, such as ammonia, or an amine, such as a polyamine having at least one basic nitrogen. Conversion of an alkenyl succinic acid or anhydride into a succinimide in described in U.S. Pat. Nos. 3,215,707 and 4,234,435, both of which are incorporated herein by reference. Suitable nitrogen sources include ammonia, monoamines, polyamines, benzyl, napthyl, phenyl, polyalkylene polyamines, and mixtures thereof. The polyalkylene polyamines may include mixtures of polyethylene polyamines having an average of 5 nitrogen atoms, triethylene tetramine (TETA), tetraethylene pentamine (TEPA), and combinations thereof.

The amines used herein are well-known in the art and generally have at least one reactive N—H bond (nitrogen to hydrogen bond). The amine is optionally further substituted with other functional groups, such as a hydroxyl. In one embodiment, the amine contains one or more primary or secondary amino groups. The monoamine in one embodiment has 1 to 22 carbon atoms. Examples of a monoamine include butylamine, methylamine, dimethylamine, an alkanolamine containing one or more hydroxy groups such as ethanolamine, or mixtures thereof.

In some cases, the polyalkylene polyamines may have at least three nitrogen atoms and about 4 to 20 carbon atoms. One or more oxygen atoms may also be present in the polyamine. Several polyamines can be used in preparing the dispersant. In addition to the nitrogen sources mentioned above, non-limiting exemplary polyamines may include aminoguanidine bicarbonate (AGBC), ethylene diamine (EDA), N-methyl propylene diamine, diethylene triamine (DETA), pentaethylene hexamine (PEHA), or other heavy polyamines. Some heavy polyamines may comprise a mixture of polyalkylene polyamines having small amounts of lower polyamine oligomers such as TEPA and PEHA, having but primarily polyamine oligomers having seven or more nitrogen atoms, two or more primary amines per molecule, and more extensive branching than conventional polyamine mixtures. Additional non-limiting polyamines which may be used to prepare the dispersant are disclosed in U.S. Pat. No. 6,548,458, the disclosure of which is incorporated herein by reference in its entirety.

Other examples of suitable polyalkylene polyamines include, but are not limited to, propylene diamine, isopropylene diamine, butylene diamine, pentylene diamine, hexylene diamine, dipropylene triamine, dimethylaminopropyl amine, diisopropylene triamine, dibutylene triamine, di-sec-butylene triamine, tripropylene tetraamine, triisobutylene tetraamine, pentaethylene hexamine, and mixtures thereof.

A particularly suitable group of polyalkylene polyamines may contain from about 2 to about 12 nitrogen atoms and from about 2 to about 24 carbon atoms. The alkylene groups of such polyalkylene polyamines may contain from about 2 to about 6 carbon atoms, more preferably from about 2 to about 4 carbon atoms. Many of the polyamines suitable for use in the present disclosure are commercially available and others may be prepared by methods which are well known in the art. For example, methods for preparing amines and their reactions are detailed in Sidgewick's "The Organic Chemistry of Nitrogen", Clarendon Press, Oxford, 1966; Noller's "Chemistry of Organic Compounds", Saunders, Philadelphia, 2nd Ed., 1957; and Kirk-Othmer's "Encyclopedia of Chemical Technology", 2nd Ed., especially Volume 2, pp. 99-116, each of which is incorporated herein by reference.

The reaction of the nitrogen source, such as ammonia or polyamine and the alkenyl succinic acid or anhydride affords mono-succinimide, bis-succinimide, tris-succinimide, or other succinimides depending on the charge ratio of the nitrogen source and alkenyl succinic acid or anhydride. The charge ratio between alkenyl succinic acid or anhydride and nitrogen source is about 1:1 to about 3.2:1, or about 2.5:1 to about 3:1, or about 2.9:1 to about 3:1, or about 1.6:1 to about 2.5:1, or about 1.6:1 to about 2:1, or about 1.6:1 to about 1.8:1, about 1.3:1 to about 1.8:1, about 1.4:1 to about 1.8:1, or about 1:6 to about 1.8:1.

The copolymer surfactants herein may include up to about 30 weight percent of such polar functional groups, in other approaches, up to about 25 weight percent, up to about 20 weight percent, or up to about 15 weight percent. The polymers may include about 5 weight percent or more of the polar groups, 10 weight percent or more, or about 15 weight percent or more of the polar groups.

In another approach, the non-polar moieties of the polymerizable surfactant may be provided from polymerizable reactants that form a main chain or backbone and may include, for example, alkyl (meth)acrylates reactants to form polyalkyl (meth)acrylate (PMA) copolymers. In such approach, the copolymers may be derived from linear or branched alkyl esters of (meth)acrylic acid. Suitable alkyl (meth)acrylate reactants may have an alkyl chain length of 1 to 20 carbons. As used herein, "(meth)acrylate" refers to both methacrylate and/or acrylate monomers or monomer units (or mixtures) as needed for particular polymeric surfactant.

As also used herein, polymerizable reactants are monomers that form a polymer or copolymer. A reactant or monomer generally refers to the compound within the reaction mixture prior to polymerization and monomer units or (alternatively) repeating units refers to the reactant or monomer as polymerized within the polymeric chain. The various monomers herein are randomly polymerized within the backbone as the monomer units or repeating units. If the discussion refers to a reactant or monomer, it also implies the resultant monomer unit or repeating unit thereof in the polymer. Likewise, if the discussion refers to a monomer unit or repeating unit, it also implies the reactant mixture or monomer mixture used to form the polymer with the associated monomer or repeating units therein.

The poly(meth)acrylate polymers suitable for the surfactants herein may be prepared by any suitable conventional or controlled free-radical polymerization technique. Examples include conventional free radical polymerization (FRP), reversible addition-fragmentation chain transfer (RAFT), atom transfer radial polymerization (ATRP), and other controlled types of polymerization known in the art. Polymerization procedures are known to those in the art and include, for instance, the use of common polymerization initiators (such as Vazo™ 67 (2.2'-Azobis(2-methylbutyronitrile), chain transfer agents (such as dodecyl mercaptane) if using conventional FRP, or RAFT agents (such as 4-cyano-4-[(dodecylsulfanylthiocarbonyl) sulfanyl] pentanoic acid and the like) if using RAFT polymerization. Other initiators, chain transfer agents, RAFT agents, ATRP catalyst and initiator systems can be used as known in the art depending on the selected polymerization method as needed for a particular application.

In yet another approach, the non-polar groups or moieties may be provided by an olefin copolymer, which may be a copolymer backbone of ethylene and an alkylene with 3 to 18 carbon atoms, for example 3 to 5, 3 to 10, 3 to 15, 5 to 10, 8 to 12, 10 to 15, or 10 to 18 carbon atoms. In some approaches, the alkylene may be propylene, isopropylene, butylene, isobutylene, n-pentylene, isopentylene, and/or neopentylene, and mixtures thereof. In other approaches, the polymers are copolymers of ethylene and one or more $C_3$ to $C_{18}$ alpha-olefins. Copolymers of ethylene and propylene are most preferred. Other alpha-olefins suitable in place of propylene to form the copolymer or to be used in combination with ethylene and propylene to form a terpolymer include 1-butene, 1-pentene, 1-hexene, 1-octene and styrene; aw-diolefins such as 1,5-hexadiene, 1,6-heptadiene, 1,7-octadiene; branched chain alpha-olefins such as 4-methylbutene-1,5-methylpentene-1 and 6-methylheptene-1; and mixtures thereof.

More complex polymer substrates, often designated as interpolymers, may be prepared using a third component and also suitable for the polymeric surfactants herein. The third component generally used to prepare an interpolymer substrate is a polyene monomer selected from non-conjugated dienes and trienes. The non-conjugated diene component is one having from 5 to 14 carbon atoms in the chain. Preferably, the diene monomer is characterized by the presence of a vinyl group in its structure and can include cyclic and bicyclo compounds. Representative dienes include 1,4-hexadiene, 1,4-cyclohexadiene, dicyclopentadiene, 5-ethylidene-2-norbornene, 5-methylene-2-norbornene, 1,5-heptadiene, and 1,6-octadiene. A mixture of more than one diene can be used in the preparation of the interpolymer. A preferred non-conjugated diene for preparing a terpolymer or interpolymer substrate is 1,4-hexadiene.

The triene component will have at least two non-conjugated double bonds, and up to about 30 carbon atoms in the chain. Typical trienes useful in preparing the interpolymer of this disclosure are 1-isopropylidene-3a,4,7,7a-tetrahydroindene, 1-isopropylidene dicyclopentadiene, dihydro-isodicyclopentadiene, and 2-(2-methylene-4-methyl-3-pentenyl) [2.2.1] bicyclo-5-heptene.

Ethylene-propylene or higher alpha-olefin copolymers may consist of from about 15 to 80 mole percent ethylene and from about 85 to 20 mole percent $C_3$ to $C_{18}$ alpha-olefin with the preferred mole ratios being from about 35 to 75 mole percent ethylene and from about 65 to 25 mole percent of a $C_3$ to $C_{18}$ alpha-olefin, with the more preferred proportions being from 50 to 70 mole percent ethylene and 50 to 30 mole percent C3 to C18 alpha-olefin, and the most preferred proportions being from 55 to 65 mole percent ethylene and 45 to 35 mole percent C3 to C18 alpha-olefin. Terpolymer variations of the foregoing polymers may contain from about 0.1 to 10 mole percent of a non-conjugated diene or triene.

The terms polymer and copolymer are used generically to encompass ethylene copolymers, terpolymers or interpolymers. These materials may contain minor amounts of other olefinic monomers so long as the basic characteristics of the ethylene copolymers are not materially changed.

In some approaches, the polymerization reaction used to form the ethylene-olefin copolymer substrate may be generally carried out in the presence of a conventional Ziegler-Natta or metallocene catalyst system. The polymerization medium is not specific and can include solution, slurry, or gas phase processes, as known to those skilled in the art. When solution polymerization is employed, the solvent may be any suitable inert hydrocarbon solvent that is liquid under reaction conditions for polymerization of alpha-olefins; examples of satisfactory hydrocarbon solvents include straight chain paraffins having from 5 to 8 carbon atoms, with hexane being preferred. Aromatic hydrocarbons, preferably aromatic hydrocarbon having a single benzene nucleus, such as benzene, toluene and the like; and saturated cyclic hydrocarbons having boiling point ranges approximating those of the straight chain paraffinic hydrocarbons and aromatic hydrocarbons described above, are particularly suitable. The solvent selected may be a mixture of one or more of the foregoing hydrocarbons. When slurry polymerization is employed, the liquid phase for polymerization is preferably liquid propylene. It is desirable that the polymerization medium be free of substances that will interfere with the catalyst components.

In some approaches or embodiments, the polymeric surfactants suitable to provide the robust low-temperature performance have a weight average molecular weight of about 40,000 or greater, about 100,000 or greater, about 150,000 or greater, about 200,000 or greater, about 300,000 or greater, or about 400,000 or greater. In other approaches or embodiments, the polymeric surfactant has a weight average molecular weight of about 800,000 or less, about 500,000 or less, about 480,000 or less, about 450,000 or less, about 300,000 or less, about 250,000 or less, about 220,000 or less, about 200,000 or less, about 150,000 or less, or about 100,000 or less. As shown in the examples below, the preferred molecular weight ranges may also relate to the selected polar functional group.

The molecular weight for any embodiment herein may be determined with a gel permeation chromatography (GPC) instrument obtained from Waters or the like instrument and the data processed with Waters Empower Software or the like software. The GPC instrument may be equipped with a Waters Separations Module and Waters Refractive Index detector (or the like optional equipment). The GPC operating conditions may include a guard column, 4 Agilent PLgel columns (length of 300×7.5 mm; particle size of 5μ, and pore size ranging from 100-10000 Å) with the column temperature at about 40° C. Un-stabilized HPLC grade tetrahydrofuran (THF) may be used as solvent, at a flow rate of 1.0 mL/min. The GPC instrument may be calibrated with commercially available polystyrene (PS) standards having a narrow molecular weight distribution ranging from 500-380,000 g/mol. The calibration curve can be extrapolated for samples having a mass less than 500 g/mol. Samples and PS standards can be in dissolved in THF and prepared at concentration of 0.1 to 0.5 wt. % and used without filtration. GPC measurements are also described in U.S. Pat. No. 5,266,223, which is incorporated herein by reference. The GPC method additionally provides molecular weight distribution information; see, for example, W. W. Yau, J. J. Kirkland and D. D. Bly, "Modern Size Exclusion Liquid Chromatography", John Wiley and Sons, New York, 1979, also incorporated herein by reference.

Lubricating Oil Compositions: The polymeric surfactants described herein may be blended with a major amount of a base oil or base oil of lubricating viscosity (as described below) in combination with one or more further optional additives to produce a lubricating oil composition that has good emulsion stability and flowability when contaminated with residual levels of water and/or gasoline and/or ethanol as well as robust low temperature viscosity characteristics. The lubricating oil compositions herein may include amounts of the active polymeric surfactant, based upon the total weight of the lubricant composition ranging from about 0.01 weight % or more, about 0.02 weight % or more, about 0.03 weight percent or more, about 0.04 weight % or more, about 0.05 weight % or more, or even 0.1 weight percent or more to about 3 weight % or less, about 2 weight % or less, about 1 weight percent or less, about 0.5 weight % or less, or about 0.4 weight percent or less, or about 0.3 weight percent or less.

As noted above, lubricating oil compositions during normal operation may become contaminated with residual amounts of fuel and/or water. In some instances, any of the lubricating composition embodiments herein may include water and/or fuel contamination in amounts of up to about 40 weight percent water contamination and/or up to about 40 weight percent fuel contamination (and other ranges therewithin). In other approaches, the lubrication oil compositions may include up to about 30 weight percent, up to about 25 weight percent, up to about 20 weight percent, up to about 15 weight percent, up to about 10 weight percent, or up to about 5 weight percent of water contamination and/or the lubrication oil compositions may include up to about 30 weight percent, up to about 25 weight percent, up to about 20 weight percent, up to about 15 weight percent, up to about 10 weight percent, or up to about 5 weight percent of fuel contamination. Even in such contaminated conditions, the lubricating compositions herein can maintain robust performance through a stable emulsion that does not impact functionality and also maintains a flowable viscosity at temperatures down to about −30° C. In some approaches, the fuel may be gasoline. As used herein, contamination refers to water and/or fuel (or other additive) that is not intentionally added to the lubricating composition. The contamination may occur through use of the lubricating composition as a lubricant in an engine.

Base Oil: The base oil used in the lubricating oil compositions herein may be selected from any of the base oils in Groups I-V as specified in the American Petroleum Institute (API) Base Oil Interchangeability Guidelines. The five base oil groups are as follows:

| Base oil Category | Sulfur (%) | | Saturates (%) | Viscosity Index |
|---|---|---|---|---|
| Group I | >0.03 | and/or | <90 | 80 to 120 |
| Group II | ≤0.03 | and | ≥90 | 80 to 120 |
| Group III | ≤0.03 | and | ≥90 | ≥120 |
| Group IV | All polyalphaolefins (PAOs) | | | |
| Group V | All others not included in Groups I, II, III, or IV | | | |

Groups I, II, and III are mineral oil process stocks. Group IV base oils contain true synthetic molecular species, which are produced by polymerization of olefinically unsaturated hydrocarbons. Many Group V base oils are also true synthetic products and may include diesters, polyol esters, polyalkylene glycols, alkylated aromatics, polyphosphate esters, polyvinyl ethers, and/or polyphenyl ethers, and the like, but may also be naturally occurring oils, such as vegetable oils. It should be noted that although Group III base oils are derived from mineral oil, the rigorous processing that these fluids undergo causes their physical properties to be very similar to some true synthetics, such as PAOs. Therefore, oils derived from Group III base oils may be referred to as synthetic fluids in the industry. Group II+ may comprise high viscosity index Group II.

The base oil used in the disclosed lubricating oil composition may be a mineral oil, animal oil, vegetable oil, synthetic oil, synthetic oil blends, or mixtures thereof. Suitable oils may be derived from hydrocracking, hydrogenation, hydrofinishing, unrefined, refined, and re-refined oils, and mixtures thereof.

Unrefined oils are those derived from a natural, mineral, or synthetic source without or with little further purification treatment. Refined oils are similar to the unrefined oils except that they have been treated in one or more purification steps, which may result in the improvement of one or more properties. Examples of suitable purification techniques are solvent extraction, secondary distillation, acid or base extraction, filtration, percolation, and the like. Oils refined to the quality of an edible may or may not be useful. Edible oils may also be called white oils. In some embodiments, lubricating oil compositions are free of edible or white oils.

Re-refined oils are also known as reclaimed or reprocessed oils. These oils are obtained similarly to refined oils using the same or similar processes. Often these oils are additionally processed by techniques directed to removal of spent additives and oil breakdown products.

Mineral oils may include oils obtained by drilling or from plants and animals or any mixtures thereof. For example such oils may include, but are not limited to, castor oil, lard oil, olive oil, peanut oil, corn oil, soybean oil, and linseed oil, as well as mineral lubricating oils, such as liquid petroleum oils and solvent-treated or acid-treated mineral lubricating oils of the paraffinic, naphthenic or mixed paraffinic-naphthenic types. Such oils may be partially or fully hydrogenated, if desired. Oils derived from coal or shale may also be useful.

Useful synthetic lubricating oils may include hydrocarbon oils such as polymerized, oligomerized, or interpolymerized olefins (e.g., polybutylenes, polypropylenes, propyleneisobutylene copolymers); poly(1-hexenes), poly(1-octenes), trimers or oligomers of 1-decene, e.g., poly(1-decenes), such materials being often referred to as α-olefins, and mixtures thereof alkyl-benzenes (e.g. dodecylbenzenes, tetradecylbenzenes, dinonylbenzenes, di-(2-ethylhexyl)-benzenes); polyphenyls (e.g., biphenyls, terphenyls, alkylated polyphenyls); diphenyl alkanes, alkylated diphenyl alkanes, alkylated diphenyl ethers and alkylated diphenyl sulfides and the derivatives, analogs and homologs thereof or mixtures thereof. Polyalphaolefins are typically hydrogenated materials.

Other synthetic lubricating oils include polyol esters, diesters, liquid esters of phosphorus-containing acids (e.g., tricresyl phosphate, trioctyl phosphate, and the diethyl ester of decane phosphonic acid), or polymeric tetrahydrofurans. Synthetic oils may be produced by Fischer-Tropsch reactions and typically may be hydroisomerized Fischer-Tropsch hydrocarbons or waxes. In one embodiment oils may be prepared by a Fischer-Tropsch gas-to-liquid synthetic procedure as well as other gas-to-liquid oils.

The major amount of base oil included in a lubricating composition may be selected from the group consisting of Group I, Group II, a Group III, a Group IV, a Group V, and a combination of two or more of the foregoing, and wherein the major amount of base oil is other than base oils that arise from provision of additive components or viscosity index improvers in the composition. In another embodiment, the major amount of base oil included in a lubricating composition may be selected from the group consisting of Group II, a Group III, a Group IV, a Group V, and a combination of two or more of the foregoing, and wherein the major amount of base oil is other than base oils that arise from provision of additive components or viscosity index improvers in the composition.

The amount of the oil of lubricating viscosity present may be the balance remaining after subtracting from 100 wt % the sum of the amount of the performance additives inclusive of viscosity index improver(s) and/or pour point depressant(s) and/or other top treat additives. For example, the oil of lubricating viscosity that may be present in a finished fluid may be a major amount, such as greater than about 50 wt %, greater than about 60 wt %, greater than about 70 wt %, greater than about 80 wt %, greater than about 85 wt %, or greater than about 90 wt %.

Antioxidants: The lubricating oil compositions herein also may optionally contain one or more antioxidants. Antioxidant compounds are known and include for example, phenates, phenate sulfides, sulfurized olefins, phosphosulfurized terpenes, sulfurized esters, aromatic amines, alkylated diphenylamines (e.g., nonyl diphenylamine, di-nonyl diphenylamine, octyl diphenylamine, di-octyl diphenylamine), phenyl-alpha-naphthyl amines, alkylated phenyl-alpha-naphthylamines, hindered non-aromatic amines, phenols, hindered phenols, oil-soluble molybdenum compounds, macromolecular antioxidants, or mixtures thereof. Antioxidant compounds may be used alone or in combination.

The hindered phenol antioxidant may contain a secondary butyl and/or a tertiary butyl group as a sterically hindering group. The phenol group may be further substituted with a hydrocarbyl group and/or a bridging group linking to a second aromatic group. Examples of suitable hindered phenol antioxidants include 2,6-di-tert-butylphenol, 4-methyl-2,6-di-tert-butylphenol, 4-ethyl-2,6-di-tert-butylphenol, 4-propyl-2,6-di-tert-butylphenol or 4-butyl-2,6-di-tert-butylphenol, or 4-dodecyl-2,6-di-tert-butylphenol. In one embodiment the hindered phenol antioxidant may be an ester and may include, e.g., Irganox™ L-135 available from BASF or an addition product derived from 2,6-di-tert-butylphenol and an alkyl acrylate, wherein the alkyl group may contain about 1 to about 18, or about 2 to about 12, or about 2 to about 8, or about 2 to about 6, or about 4 carbon atoms. Another commercially available hindered phenol antioxidant may be an ester and may include Ethanox™ 4716 available from Albemarle Corporation.

Useful antioxidants may include diarylamines and high molecular weight phenols. In an embodiment, the lubricating oil composition may contain a mixture of a diarylamine and a high molecular weight phenol, such that each antioxidant may be present in an amount sufficient to provide up to about 5%, by weight, based upon the final weight of the lubricating oil composition. In an embodiment, the antioxidant may be a mixture of about 0.3 to about 1.5% diarylamine and about 0.4 to about 2.5% high molecular weight phenol, by weight, based upon the final weight of the lubricating oil composition.

Examples of suitable olefins that may be sulfurized to form a sulfurized olefin include propylene, butylene, isobutylene, polyisobutylene, pentene, hexene, heptene, octene, nonene, decene, undecene, dodecene, tridecene, tetradecene, pentadecene, hexadecene, heptadecene, octadecene, nonadecene, eicosene or mixtures thereof. In one embodiment, hexadecene, heptadecene, octadecene, nonadecene, eicosene or mixtures thereof and their dimers, trimers and tetramers are especially useful olefins. Alternatively, the olefin may be a Diels-Alder adduct of a diene such as 1,3-butadiene and an unsaturated ester, such as, butylacrylate.

Another class of sulfurized olefin includes sulfurized fatty acids and their esters. The fatty acids are often obtained from vegetable oil or animal oil and typically contain about 4 to about 22 carbon atoms. Examples of suitable fatty acids and their esters include triglycerides, oleic acid, linoleic acid, palmitoleic acid or mixtures thereof. Often, the fatty acids are obtained from lard oil, tall oil, peanut oil, soybean oil, cottonseed oil, sunflower seed oil or mixtures thereof. Fatty acids and/or ester may be mixed with olefins, such as α-olefins.

In another alternative embodiment the antioxidant composition also contains a molybdenum-containing antioxidant in addition to the phenolic and/or aminic antioxidants discussed above. When a combination of these three antioxidants is used, preferably the ratio of phenolic to aminic to molybdenum-containing is (0 to 2):(0 to 2):(0 to 1).

The one or more antioxidant(s) may be present in ranges about 0 wt % to about 20 wt %, or about 0.1 wt % to about 10 wt %, or about 1 wt % to about 5 wt %, of the lubricating oil composition.

Antiwear Agents: The lubricating oil compositions herein also may optionally contain one or more antiwear agents. Examples of suitable antiwear agents include, but are not limited to, a metal thiophosphate; a metal dialkyldithiophosphate; a phosphoric acid ester or salt thereof; a phosphate ester(s); a phosphite; a phosphorus-containing carboxylic ester, ether, or amide; a sulfurized olefin; thiocarbamate-containing compounds including, thiocarbamate esters, alkylene-coupled thiocarbamates, and bis(S-alkyldithiocarbamyl)disulfides; and mixtures thereof. A suitable antiwear agent may be a molybdenum dithiocarbamate. The phosphorus containing antiwear agents are more fully described in European Patent 612 839. The metal in the dialkyl dithio phosphate salts may be an alkali metal, alkaline earth metal, aluminum, lead, tin, molybdenum, manganese, nickel, copper, titanium, or zinc. A useful antiwear agent may be zinc dialkyldithiophosphate.

Further examples of suitable antiwear agents include titanium compounds, tartrates, tartrimides, oil soluble amine salts of phosphorus compounds, sulfurized olefins, phosphites (such as dibutyl phosphite), phosphonates, thiocarbamate-containing compounds, such as thiocarbamate esters, thiocarbamate amides, thiocarbamic ethers, alkylene-coupled thiocarbamates, and bis(S-alkyldithiocarbamyl) disulfides. The tartrate or tartrimide may contain alkyl-ester groups, where the sum of carbon atoms on the alkyl groups may be at least 8. The antiwear agent may in one embodiment include a citrate.

The antiwear agent may be present in ranges including about 0 wt % to about 15 wt %, or about 0.01 wt % to about 10 wt %, or about 0.05 wt % to about 5 wt %, or about 0.1 wt % to about 3 wt % of the lubricating oil composition.

Boron-Containing Compounds: The lubricating oil compositions herein may optionally contain one or more boron-containing compounds. Examples of boron-containing compounds include borate esters, borated fatty amines, borated epoxides, borated detergents, and borated dispersants, such as borated succinimide dispersants, as disclosed in U.S. Pat. No. 5,883,057. The boron-containing compound, if present, can be used in an amount sufficient to provide up to about 8 wt %, about 0.01 wt % to about 7 wt %, about 0.05 wt % to about 5 wt %, or about 0.1 wt % to about 3 wt % of the lubricating oil composition.

Detergents: The lubricating oil composition may optionally further comprise one or more neutral, low based, or overbased detergents, and mixtures thereof. Suitable detergent substrates include phenates, sulfur containing phenates, sulfonates, calixarates, salixarates, salicylates, carboxylic acids, phosphorus acids, mono- and/or di-thiophosphoric acids, alkyl phenols, sulfur coupled alkyl phenol compounds, or methylene bridged phenols. Suitable detergents and their methods of preparation are described in greater detail in numerous patent publications, including U.S. Pat. No. 7,732,390 and references cited therein.

The detergent substrate may be salted with an alkali or alkaline earth metal such as, but not limited to, calcium, magnesium, potassium, sodium, lithium, barium, or mixtures thereof. In some embodiments, the detergent is free of barium. In some embodiments, a detergent may contain traces of other metals such as magnesium or calcium in amounts such as 50 ppm or less, 40 ppm or less, 30 ppm or less, 20 ppm or less, or 10 ppm or less. A suitable detergent may include alkali or alkaline earth metal salts of petroleum sulfonic acids and long chain mono- or di-alkylarylsulfonic acids with the aryl group being benzyl, tolyl, and xylyl. Examples of suitable detergents include, but are not limited to, calcium phenates, calcium sulfur containing phenates, calcium sulfonates, calcium calixarates, calcium salixarates, calcium salicylates, calcium carboxylic acids, calcium phosphorus acids, calcium mono- and/or di-thiophosphoric acids, calcium alkyl phenols, calcium sulfur coupled alkyl phenol compounds, calcium methylene bridged phenols, magnesium phenates, magnesium sulfur containing phenates, magnesium sulfonates, magnesium calixarates, magnesium salixarates, magnesium salicylates, magnesium carboxylic acids, magnesium phosphorus acids, magnesium mono- and/or di-thiophosphoric acids, magnesium alkyl phenols, magnesium sulfur coupled alkyl phenol compounds, magnesium methylene bridged phenols, sodium phenates, sodium sulfur containing phenates, sodium sulfonates, sodium calixarates, sodium salixarates, sodium salicylates, sodium carboxylic acids, sodium phosphorus acids, sodium mono- and/or di-thiophosphoric acids, sodium alkyl phenols, sodium sulfur coupled alkyl phenol compounds, or sodium methylene bridged phenols.

Overbased detergent additives are well known in the art and may be alkali or alkaline earth metal overbased detergent additives. Such detergent additives may be prepared by reacting a metal oxide or metal hydroxide with a substrate and carbon dioxide gas. The substrate is typically an acid, for example, an acid such as an aliphatic substituted sulfonic acid, an aliphatic substituted carboxylic acid, or an aliphatic substituted phenol.

The terminology "overbased" relates to metal salts, such as metal salts of sulfonates, carboxylates, and phenates, wherein the amount of metal present exceeds the stoichiometric amount. Such salts may have a conversion level in excess of 100% (i.e., they may comprise more than 100% of the theoretical amount of metal needed to convert the acid to its "normal," "neutral" salt). The expression "metal ratio," often abbreviated as MR, is used to designate the ratio of total chemical equivalents of metal in the overbased salt to chemical equivalents of the metal in a neutral salt according to known chemical reactivity and stoichiometry. In a normal or neutral salt, the metal ratio is one and in an overbased salt, MR, is greater than one. They are commonly referred to as overbased, hyperbased, or superbased salts and may be salts of organic sulfur acids, carboxylic acids, or phenols.

An overbased detergent of the lubricating oil composition may have a total base number (TBN) of about 200 mg KOH/gram or greater, or as further examples, about 250 mg KOH/gram or greater, or about 350 mg KOH/gram or greater, or about 375 mg KOH/gram or greater, or about 400 mg KOH/gram or greater.

Examples of suitable overbased detergents include, but are not limited to, overbased calcium phenates, overbased calcium sulfur containing phenates, overbased calcium sulfonates, overbased calcium calixarates, overbased calcium salixarates, overbased calcium salicylates, overbased calcium carboxylic acids, overbased calcium phosphorus acids, overbased calcium mono- and/or di-thiophosphoric acids, overbased calcium alkyl phenols, overbased calcium sulfur coupled alkyl phenol compounds, overbased calcium methylene bridged phenols, overbased magnesium phenates, overbased magnesium sulfur containing phenates, overbased magnesium sulfonates, overbased magnesium calixarates, overbased magnesium salixarates, overbased magnesium salicylates, overbased magnesium carboxylic acids, overbased magnesium phosphorus acids, overbased magnesium mono- and/or di-thiophosphoric acids, overbased magnesium alkyl phenols, overbased magnesium sulfur coupled alkyl phenol compounds, or overbased magnesium methylene bridged phenols.

The overbased calcium phenate detergents have a total base number of at least about 150 mg KOH/g, at least about 225 mg KOH/g, at least about 225 mg KOH/g to about 400 mg KOH/g, at least about 225 mg KOH/g to about 350 mg KOH/g or about 230 mg KOH/g to about 350 mg KOH/g, all as measured by the method of ASTM D-2896. When such detergent compositions are formed in an inert diluent, e.g. a process oil, usually a mineral oil, the total base number reflects the basicity of the overall composition including diluent, and any other materials (e.g., promoter, etc.) that may be contained in the detergent composition.

The overbased detergent may have a metal to substrate ratio of from 1.1:1, or from 2:1, or from 4:1, or from 5:1, or from 7:1, or from 10:1. In some embodiments, a detergent is effective at reducing or preventing rust in an engine. The detergent may be present at about 0 wt % to about 10 wt %, or about 0.1 wt % to about 8 wt %, or about 1 wt % to about 4 wt %, or greater than about 4 wt % to about 8 wt %.

Dispersants: The lubricating oil composition may optionally further comprise one or more dispersants or mixtures thereof. Dispersants are often known as ashless-type dispersants because, prior to mixing in a lubricating oil composition, they do not contain ash-forming metals and they do not normally contribute any ash when added to a lubricant. Ashless type dispersants are characterized by a polar group attached to a relatively high molecular weight hydrocarbon chain. Typical ashless dispersants include N-substituted long chain alkenyl succinimides. Examples of N-substituted long chain alkenyl succinimides include polyisobutylene succinimide with the number average molecular weight of the polyisobutylene substituent being in the range about 350 to about 50,000, or to about 5,000, or to about 3,000, as measured by GPC. Succinimide dispersants and their preparation are disclosed, for instance in U.S. Pat. No. 7,897,696 or 4,234,435. The polyolefin may be prepared from polymerizable monomers containing about 2 to about 16, or about 2 to about 8, or about 2 to about 6 carbon atoms. Succinimide dispersants are typically the imide formed from a polyamine, typically a poly(ethyleneamine).

Preferred amines are selected from polyamines and hydroxyamines. Examples of polyamines that may be used include, but are not limited to, diethylene triamine (DETA), triethylene tetramine (TETA), tetraethylene pentamine (TEPA), and higher homologues such as pentaethylamine hexamine (PEHA), and the like.

A suitable heavy polyamine is a mixture of polyalkylenepolyamines comprising small amounts of lower polyamine oligomers such as TEPA and PEHA (pentaethylene hexamine) but primarily oligomers with 6 or more nitrogen atoms, 2 or more primary amines per molecule, and more extensive branching than conventional polyamine mixtures. A heavy polyamine preferably includes polyamine oligomers containing 7 or more nitrogens per molecule and with 2 or more primary amines per molecule. The heavy polyamine comprises more than 28 wt. % (e.g. >32 wt. %) total nitrogen and an equivalent weight of primary amine groups of 120-160 grams per equivalent.

Suitable polyamines are commonly known as PAM and contain a mixture of ethylene amines where TEPA and pentaethylene hexamine (PEHA) are the major part of the polyamine, usually less than about 80%.

Typically, PAM has 8.7-8.9 milliequivalents of primary amine per gram (an equivalent weight of 115 to 112 grams per equivalent of primary amine) and a total nitrogen content of about 33-34 wt. %. Heavier cuts of PAM oligomers with practically no TEPA and only very small amounts of PEHA but containing primarily oligomers with more than 6 nitrogens and more extensive branching, may produce dispersants with improved dispersancy.

In an embodiment the present disclosure further comprises at least one polyisobutylene succinimide dispersant derived from polyisobutylene with a number average molecular weight in the range about 350 to about 50,000, or to about 5000, or to about 3000, as determined by GPC. The polyisobutylene succinimide may be used alone or in combination with other dispersants.

In some embodiments, polyisobutylene, when included, may have greater than 50 mol %, greater than 60 mol %, greater than 70 mol %, greater than 80 mol %, or greater than 90 mol % content of terminal double bonds. Such PM is also referred to as highly reactive PM ("HR-PIB"). HR-PM having a number average molecular weight ranging from about 800 to about 5000, as determined by GPC, is suitable for use in embodiments of the present disclosure. Conventional PIB typically has less than 50 mol %, less than 40 mol %, less than 30 mol %, less than 20 mol %, or less than 10 mol % content of terminal double bonds.

An HR-PIB having a number average molecular weight ranging from about 900 to about 3000 may be suitable, as determined by GPC. Such HR-PIB is commercially available, or can be synthesized by the polymerization of isobutene in the presence of a non-chlorinated catalyst such as boron trifluoride, as described in U.S. Pat. No. 4,152,499 to Boerzel, et al. and U.S. Pat. No. 5,739,355 to Gateau, et al. When used in the aforementioned thermal ene reaction, HR-PIB may lead to higher conversion rates in the reaction, as well as lower amounts of sediment formation, due to increased reactivity. A suitable method is described in U.S. Pat. No. 7,897,696.

In one embodiment the present disclosure further comprises at least one dispersant derived from polyisobutylene succinic anhydride ("PIMA"). The PIMA may have an average of between about 1.0 and about 2.0 succinic acid moieties per polymer.

The % actives of the alkenyl or alkyl succinic anhydride can be determined using a chromatographic technique. This method is described in column 5 and 6 in U.S. Pat. No. 5,334,321.

The percent conversion of the polyolefin is calculated from the % actives using the equation in column 5 and 6 in U.S. Pat. No. 5,334,321.

Unless stated otherwise, all percentages are in weight percent and all molecular weights are number average molecular weights determined by gel permeation chromatography (GPC) using commercially available polystyrene standards (with a number average molecular weight of 180 to about 18,000 as the calibration reference).

In one embodiment, the dispersant may be derived from a polyalphaolefin (PAO) succinic anhydride. In one embodiment, the dispersant may be derived from olefin maleic anhydride copolymer. As an example, the dispersant may be described as a poly-PIBSA. In an embodiment, the dispersant may be derived from an anhydride which is grafted to an ethylene-propylene copolymer.

A suitable class of nitrogen-containing dispersants may be derived from olefin copolymers (OCP), more specifically, ethylene-propylene dispersants which may be grafted with maleic anhydride. A more complete list of nitrogen-containing compounds that can be reacted with the functionalized OCP are described in U.S. Pat. Nos. 7,485,603; 7,786,057; 7,253,231; 6,107,257; and 5,075,383; and/or are commercially available.

The hydrocarbyl moiety of the hydrocarbyl-dicarboxylic acid or anhydride of Component A) may alternatively be derived from ethylene-alpha olefin copolymers. These copolymers contain a plurality of ethylene units and a plurality of one or more $C_3$-$C_{10}$ alpha-olefin units. The $C_3$-$C_{10}$ alpha-olefin units may include propylene units.

The ethylene-alpha olefin copolymer typically has a number average molecular weight of less than 5,000 g/mol, as measured by GPC using polystyrene as a calibration reference; or the number average molecular weight of the copolymer may be less than 4,000 g/mol, or less than 3,500 g/mol, or less than 3,000 g/mol, or less than 2,500 g/mol, or less than 2,000 g/mol, or less than 1,500 g/mol, or less than 1,000 g/mol. In some embodiments, the number average molecular weight of the copolymer may be between 800 and 3,000 g/mol.

The ethylene content of the ethylene-alpha olefin copolymer may less than 80 mol %; less than 70 mol %, or less than 65 mol %, or less than 60 mol %, or less than 55 mol %, or less than 50 mol %, or less than 45 mol %, or less than 40 mol %. The ethylene content of the copolymer may be at least 10 mol % and less than 80 mol %, or at least 20 mol % and less than 70 mol %, or at least 30 mol % and less than 65 mol %, or at least 40 mol % and less than 60 mol %.

The $C_3$-$C_{10}$ alpha-olefin content of the ethylene-alpha olefin copolymer may be at least 20 mol %, or at least 30 mol %, or at least 35 mol %, or at least 40 mol %, or at least 45 mol %, or at least 50 mol %, or at least 55 mol %, or at least 60 mol %.

In some embodiments, at least 70 mol % of molecules of the ethylene-alpha olefin copolymer may have an unsaturated group, and at least 70 mol % of said unsaturated groups may be located in a terminal vinylidene group or a tri-substituted isomer of a terminal vinylidene group or at least 75 mol % of the copolymer terminates in the terminal vinylidene group or the tri-substituted isomer of the terminal vinylidene group, or at least 80 mol % of the copolymer terminates in the terminal vinylidene group or the tri-substituted isomer of the terminal vinylidene group, or at least 80 mol % of the copolymer terminates in the terminal vinylidene group or the tri-substituted isomer of the terminal vinylidene group, or at least 85 mol % of the copolymer terminates in the terminal vinylidene group or the tri-substituted isomer of the terminal vinylidene group, or at least 90 mol % of the copolymer terminates in the terminal vinylidene group or the tri-substituted isomer of the terminal vinylidene group, or at least 95 mol % of the copolymer terminates in the terminal vinylidene group or the tri-substituted isomer of the terminal vinylidene group. the terminal vinylidene and the tri-substituted isomers of the terminal vinylidene of the copolymer have one or more of the following structural formulas (A)-(C):

(A)

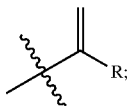

-continued (B)

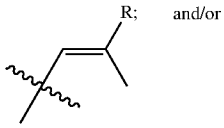

(C)

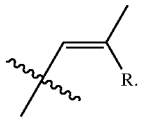

wherein R represents a $C_1$-$C_8$ alkyl group and "$\frac{\S}{\S}$" indicates the bond is attached to the remaining portion of the copolymer.

The ethylene-alpha olefin copolymer may have an average ethylene unit run length ($n_{C2}$) which is less than 2.8, as determined by $^{13}C$ NMR spectroscopy, and also satisfies the relationship shown by the expression below:

$$n_{C2} < \frac{(EEE + FEA + AEA)}{(AEA + 0.5EEA)}$$

wherein $$EEE = (x_{C2})^3,$$

$$EEA = 2(x_{C2})^2(1 - x_{C2}),$$

$$AEA = x_{C2}(1 - x_{C2})^2,$$

$x_{C2}$ being the mole fraction of ethylene incorporated in the polymer as measured by $^1H$-NMR spectroscopy, E representing an ethylene unit, and A representing an alpha-olefin unit. The copolymer may have an average ethylene unit run length of less than 2.6, or less than 2.4, or less than 2.2, or less than 2. The average ethylene run length $n_{c2}$ may also satisfy the relationship shown by the expression below: wherein $n_{C2Actual} < n_{C2Statistical}$.

The crossover temperature of the ethylene-alpha olefin copolymer may be −20° C. or lower, or −25° C. or lower, or −30° C. or lower, or −35° C. or lower, or −40° C. or lower. The copolymer may have a polydispersity index of less than or equal to 4, or less than or equal to 3, or less than or equal to 2. Less than 20% of unit triads in the copolymer may be ethylene-ethylene-ethylene triads, or less than 10% of unit triads in the copolymer are ethylene-ethylene-ethylene triads, or less than 5% of unit triads in the copolymer are ethylene-ethylene-ethylene triads. Further details of the ethylene-alpha olefin copolymers and dispersants made therefrom may be found in PCT/US18/37116 filed at the U.S. Receiving Office, the disclosure of which is hereby incorporated by reference in its entirety.

One class of suitable dispersants may be Mannich bases. Mannich bases are materials that are formed by the condensation of a higher molecular weight, alkyl substituted phenol, a polyalkylene polyamine, and an aldehyde such as formaldehyde. Mannich bases are described in more detail in U.S. Pat. No. 3,634,515.

A suitable class of dispersants may be high molecular weight esters or half ester amides. A suitable dispersant may also be post-treated by conventional methods by a reaction with any of a variety of agents. Among these are boron, urea, thiourea, dimercaptothiadiazoles, carbon disulfide, aldehydes, ketones, carboxylic acids, hydrocarbon-substituted succinic anhydrides, maleic anhydride, nitriles, epoxides, carbonates, cyclic carbonates, hindered phenolic esters, and phosphorus compounds. U.S. Pat. Nos. 7,645,726; 7,214,649; and 8,048,831 are incorporated herein by reference in their entireties.

In addition to the carbonate and boric acids post-treatments both the compounds may be post-treated, or further post-treatment, with a variety of post-treatments designed to improve or impart different properties. Such post-treatments include those summarized in columns 27-29 of U.S. Pat. No. 5,241,003, hereby incorporated by reference. Such treatments include, treatment with: Inorganic phosphorous acids or anhydrates (e.g., U.S. Pat. Nos. 3,403,102 and 4,648,980); Organic phosphorous compounds (e.g., U.S. Pat. No. 3,502,677); Phosphorous pentasulfides; Boron compounds as already noted above (e.g., U.S. Pat. Nos. 3,178,663 and 4,652,387); Carboxylic acid, polycarboxylic acids, anhydrides and/or acid halides (e.g., U.S. Pat. Nos. 3,708,522 and 4,948,386); Epoxides polyepoxiates or thioexpoxides (e.g., U.S. Pat. Nos. 3,859,318 and 5,026,495); Aldehyde or ketone (e.g., U.S. Pat. No. 3,458,530); Carbon disulfide (e.g., U.S. Pat. No. 3,256,185); Glycidol (e.g., U.S. Pat. No. 4,617,137); Urea, thiourea or guanidine (e.g., U.S. Pat. Nos. 3,312,619; 3,865,813; and British Patent GB 1,065,595); Organic sulfonic acid (e.g., U.S. Pat. No. 3,189,544 and British Patent GB 2,140,811); Alkenyl cyanide (e.g., U.S. Pat. Nos. 3,278,550 and 3,366,569); Diketene (e.g., U.S. Pat. No. 3,546,243); A diisocyanate (e.g., U.S. Pat. No. 3,573,205); Alkane sultone (e.g., U.S. Pat. No. 3,749,695); 1,3-Dicarbonyl Compound (e.g., U.S. Pat. No. 4,579,675); Sulfate of alkoxylated alcohol or phenol (e.g., U.S. Pat. No. 3,954,639); Cyclic lactone (e.g., U.S. Pat. Nos. 4,617,138; 4,645,515; 4,668,246; 4,963,275; and 4,971,711); Cyclic carbonate or thiocarbonate linear monocarbonate or polycarbonate, or chloroformate (e.g., U.S. Pat. Nos. 4,612,132; 4,647,390; 4,648,886; 4,670,170); Nitrogen-containing carboxylic acid (e.g., U.S. Pat. No. 4,971,598 and British Patent GB 2,140,811); Hydroxy-protected chlorodicarbonyloxy compound (e.g., U.S. Pat. No. 4,614,522); Lactam, thiolactam, thiolactone or ditholactone (e.g., U.S. Pat. Nos. 4,614,603 and 4,666,460); Cyclic carbonate or thiocarbonate, linear monocarbonate or plycarbonate, or chloroformate (e.g., U.S. Pat. Nos. 4,612,132; 4,647,390; 4,646,860; and 4,670,170); Nitrogen-containing carboxylic acid (e.g., U.S. Pat. No. 4,971,598 and British Patent GB 2,440,811); Hydroxy-protected chlorodicarbonyloxy compound (e.g., U.S. Pat. No. 4,614,522); Lactam, thiolactam, thiolactone or dithiolactone (e.g., U.S. Pat. Nos. 4,614,603, and 4,666,460); Cyclic carbamate, cyclic thiocarbamate or cyclic dithiocarbamate (e.g., U.S. Pat. Nos. 4,663,062 and 4,666,459); Hydroxyaliphatic carboxylic acid (e.g., U.S. Pat. Nos. 4,482,464; 4,521,318; 4,713,189); Oxidizing agent (e.g., U.S. Pat. No. 4,379,064); Combination of phosphorus pentasulfide and a polyalkylene polyamine (e.g., U.S. Pat. No. 3,185,647); Combination of carboxylic acid or an aldehyde or ketone and sulfur or sulfur chloride (e.g., U.S. Pat. Nos. 3,390,086; 3,470,098); Combination of a hydrazine and carbon disulfide (e.g. U.S. Pat. No. 3,519,564); Combination of an aldehyde and a phenol (e.g., U.S. Pat. Nos. 3,649,229; 5,030,249; 5,039,307); Combination of an aldehyde and an O-diester of dithiophosphoric acid (e.g., U.S. Pat. No. 3,865,740); Combination of a hydroxyaliphatic carboxylic acid and a boric acid (e.g., U.S. Pat. No. 4,554,086); Combination of a hydroxyaliphatic carboxylic acid, then formaldehyde and a phenol (e.g., U.S. Pat. No. 4,636,322); Combination of a hydroxyaliphatic carboxylic acid and then an aliphatic dicarboxylic acid (e.g., U.S. Pat. No. 4,663,064); Combination of formaldehyde and a phenol and then glycolic acid (e.g., U.S. Pat. No. 4,699,724); Combination of a hydroxyaliphatic carboxylic acid or oxalic acid and then a diisocyanate (e.g. U.S. Pat. No. 4,713,191); Combination of inorganic acid or anhydride of phosphorus or a partial or total sulfur analog thereof and a boron compound (e.g., U.S. Pat. No. 4,857,214); Combination of an organic diacid then an unsaturated fatty acid and then a nitrosoaromatic amine optionally followed by a boron compound and then a glycolating agent (e.g., U.S. Pat. No. 4,973,412); Combination of an aldehyde and a triazole (e.g., U.S. Pat. No. 4,963,278); Combination of an aldehyde and a triazole then a boron compound (e.g., U.S. Pat. No. 4,981,492); Combination of cyclic lactone and a boron compound (e.g., U.S. Pat. Nos. 4,963,275 and 4,971,711). The above-mentioned patents are herein incorporated in their entireties.

The TBN of a suitable dispersant may be from about 10 to about 65 mg KOH/g dispersant, on an oil-free basis, which is comparable to about 5 to about 30 TBN if measured on a dispersant sample containing about 50% diluent oil. TBN is measured by the method of ASTM D2896.

The dispersant, if present, can be used in an amount sufficient to provide up to about 20 wt %, based upon the final weight of the lubricating oil composition. Another amount of the dispersant that can be used may be about 0.1 wt % to about 15 wt %, or about 0.1 wt % to about 10 wt %, or about 3 wt % to about 10 wt %, or about 1 wt % to about 6 wt %, or about 7 wt % to about 12 wt %, based upon the final weight of the lubricating oil composition. In some embodiments, the lubricating oil composition utilizes a mixed dispersant system. A single type or a mixture of two or more types of dispersants in any desired ratio may be used.

Extreme Pressure Agents: The lubricating oil compositions herein also may optionally contain one or more extreme pressure agents. Extreme Pressure (EP) agents that are soluble in the oil include sulfur- and chlorosulfur-containing EP agents, chlorinated hydrocarbon EP agents and phosphorus EP agents. Examples of such EP agents include chlorinated wax; organic sulfides and polysulfides such as dibenzyldisulfide, bis(chlorobenzyl) disulfide, dibutyl tetrasulfide, sulfurized methyl ester of oleic acid, sulfurized alkylphenol, sulfurized dipentene, sulfurized terpene, and sulfurized Diels-Alder adducts; phosphosulfurized hydrocarbons such as the reaction product of phosphorus sulfide with turpentine or methyl oleate; phosphorus esters such as the dihydrocarbyl and trihydrocarbyl phosphites, e.g., dibutyl phosphite, diheptyl phosphite, dicyclohexyl phosphite, pentylphenyl phosphite; dipentylphenyl phosphite, tridecyl phosphite, distearyl phosphite and polypropylene substituted phenyl phosphite; metal thiocarbamates such as zinc dioctyldithiocarbamate and barium heptylphenol diacid; amine salts of alkyl and dialkylphosphoric acids, including, for example, the amine salt of the reaction product of a dialkyldithiophosphoric acid with propylene oxide; and mixtures thereof.

Friction Modifiers: The lubricating oil compositions herein also may optionally contain one or more friction modifiers. Suitable friction modifiers may comprise metal containing and metal-free friction modifiers and may include, but are not limited to, imidazolines, amides, amines, succinimides, alkoxylated amines, alkoxylated ether amines, amine oxides, amidoamines, nitriles, betaines, quaternary amines, imines, amine salts, amino guanadine, alkanolamides, phosphonates, metal-containing compounds, glycerol esters, sulfurized fatty compounds and olefins, sunflower oil other naturally occurring plant or animal oils, dicarboxylic acid esters, esters or partial esters of a polyol and one or more aliphatic or aromatic carboxylic acids, and the like.

Suitable friction modifiers may contain hydrocarbyl groups that are selected from straight chain, branched chain, or aromatic hydrocarbyl groups or mixtures thereof, and may be saturated or unsaturated. The hydrocarbyl groups may be composed of carbon and hydrogen or hetero atoms such as sulfur or oxygen. The hydrocarbyl groups may range from about 12 to about 25 carbon atoms. In some embodiments the friction modifier may be a long chain fatty acid ester. In another embodiment the long chain fatty acid ester may be a mono-ester, or a di-ester, or a (tri)glyceride. The friction modifier may be a long chain fatty amide, a long chain fatty ester, a long chain fatty epoxide derivatives, or a long chain imidazoline.

Other suitable friction modifiers may include organic, ashless (metal-free), nitrogen-free organic friction modifiers. Such friction modifiers may include esters formed by reacting carboxylic acids and anhydrides with alkanols and generally include a polar terminal group (e.g. carboxyl or hydroxyl) covalently bonded to an oleophilic hydrocarbon chain. An example of an organic ashless nitrogen-free friction modifier is known generally as glycerol monooleate (GMO) which may contain mono-, di-, and tri-esters of oleic acid. Other suitable friction modifiers are described in U.S. Pat. No. 6,723,685, herein incorporated by reference in its entirety.

Aminic friction modifiers may include amines or polyamines. Such compounds can have hydrocarbyl groups that are linear, either saturated or unsaturated, or a mixture thereof and may contain from about 12 to about 25 carbon atoms. Further examples of suitable friction modifiers include alkoxylated amines and alkoxylated ether amines. Such compounds may have hydrocarbyl groups that are linear, either saturated, unsaturated, or a mixture thereof. They may contain from about 12 to about 25 carbon atoms. Examples include ethoxylated amines and ethoxylated ether amines.

The amines and amides may be used as such or in the form of an adduct or reaction product with a boron compound such as a boric oxide, boron halide, metaborate, boric acid or a mono-, di- or tri-alkyl borate. Other suitable friction modifiers are described in U.S. Pat. No. 6,300,291, herein incorporated by reference in its entirety.

A friction modifier may optionally be present in ranges such as about 0 wt % to about 10 wt %, or about 0.01 wt % to about 8 wt %, or about 0.1 wt % to about 4 wt %.

Molybdenum-containing component: The lubricating oil compositions herein also may optionally contain one or more molybdenum-containing compounds. An oil-soluble molybdenum compound may have the functional performance of an antiwear agent, an antioxidant, a friction modifier, or mixtures thereof. An oil-soluble molybdenum compound may include molybdenum dithiocarbamates, molybdenum dialkyldithiophosphates, molybdenum dithiophosphinates, amine salts of molybdenum compounds, molybdenum xanthates, molybdenum thioxanthates, molybdenum sulfides, molybdenum carboxylates, molybdenum alkoxides, a trinuclear organo-molybdenum compound, and/or mixtures thereof. The molybdenum sulfides include molybdenum disulfide. The molybdenum disulfide may be in the form of a stable dispersion. In one embodiment the oil-soluble molybdenum compound may be selected from the group consisting of molybdenum dithiocarbamates, molybdenum dialkyldithiophosphates, amine salts of molybdenum compounds, and mixtures thereof. In one embodiment the oil-soluble molybdenum compound may be a molybdenum dithiocarbamate.

Suitable examples of molybdenum compounds which may be used include commercial materials sold under the trade names such as Molyvan 822™, Molyvan™ A, Molyvan 2000™ and Molyvan 855™ from R. T. Vanderbilt Co., Ltd., and Sakura-Lube™ S-165, S-200, S-300, 5-310G, S-525, S-600, S-700, and S-710 available from Adeka Corporation, and mixtures thereof. Suitable molybdenum components are described in U.S. Pat. No. 5,650,381; US RE 37,363 E1; US RE 38,929 E1; and US RE 40,595 E1, incorporated herein by reference in their entireties.

Additionally, the molybdenum compound may be an acidic molybdenum compound. Included are molybdic acid, ammonium molybdate, sodium molybdate, potassium molybdate, and other alkaline metal molybdates and other molybdenum salts, e.g., hydrogen sodium molybdate, MoOCl4, MoO2Br2, Mo2O3Cl6, molybdenum trioxide or similar acidic molybdenum compounds. Alternatively, the compositions can be provided with molybdenum by molybdenum/sulfur complexes of basic nitrogen compounds as described, for example, in U.S. Pat. Nos. 4,263,152; 4,285,822; 4,283,295; 4,272,387; 4,265,773; 4,261,843; 4,259,195 and 4,259,194; and WO 94/06897, incorporated herein by reference in their entireties.

Another class of suitable organo-molybdenum compounds are trinuclear molybdenum compounds, such as those of the formula Mo3SkLnQz and mixtures thereof, wherein S represents sulfur, L represents independently selected ligands having organo groups with a sufficient number of carbon atoms to render the compound soluble or dispersible in the oil, n is from 1 to 4, k varies from 4 through 7, Q is selected from the group of neutral electron donating compounds such as water, amines, alcohols, phosphines, and ethers, and z ranges from 0 to 5 and includes non-stoichiometric values. At least 21 total carbon atoms may be present among all the ligands' organo groups, such as at least 25, at least 30, or at least 35 carbon atoms. Additional suitable molybdenum compounds are described in U.S. Pat. No. 6,723,685, herein incorporated by reference in its entirety.

The oil-soluble molybdenum compound may be present in an amount sufficient to provide about 0.5 ppm to about 2000 ppm, about 1 ppm to about 700 ppm, about 1 ppm to about 550 ppm, about 5 ppm to about 300 ppm, or about 20 ppm to about 250 ppm of molybdenum.

Transition Metal-containing compounds: In another embodiment, the oil-soluble compound may be a transition metal containing compound or a metalloid. The transition metals may include, but are not limited to, titanium, vanadium, copper, zinc, zirconium, molybdenum, tantalum, tungsten, and the like. Suitable metalloids include, but are not limited to, boron, silicon, antimony, tellurium, and the like.

In an embodiment, an oil-soluble transition metal-containing compound may function as antiwear agents, friction modifiers, antioxidants, deposit control additives, or more than one of these functions. In an embodiment the oil-soluble transition metal-containing compound may be an oil-soluble titanium compound, such as a titanium (IV) alkoxide. Among the titanium containing compounds that may be used in, or which may be used for preparation of the oils-soluble materials of, the disclosed technology are various Ti (IV) compounds such as titanium (IV) oxide; titanium (IV) sulfide; titanium (IV) nitrate; titanium (IV) alkoxides such as titanium methoxide, titanium ethoxide, titanium propoxide, titanium isopropoxide, titanium butoxide, titanium 2-ethylhexoxide; and other titanium compounds or complexes including but not limited to titanium phenates; titanium carboxylates such as titanium (IV) 2-ethyl-1-3-hexanedioate or titanium citrate or titanium oleate; and titanium (IV) (triethanolaminato)isopropoxide. Other forms of titanium encompassed within the disclosed technology include titanium phosphates such as titanium dithiophosphates (e.g., dialkyldithiophosphates) and titanium sulfonates (e.g., alkylbenzenesulfonates), or, generally, the reaction product of titanium compounds with various acid materials to form salts, such as oil-soluble salts. Titanium compounds can thus be derived from, among others, organic acids, alcohols, and glycols. Ti compounds may also exist in dimeric or oligomeric form, containing Ti—O—Ti structures. Such titanium materials are commercially available or can be readily prepared by appropriate synthesis techniques which will be apparent to the person skilled in the art. They may exist at room temperature as a solid or a liquid, depending on the particular compound. They may also be provided in a solution form in an appropriate inert solvent.

In one embodiment, the titanium can be supplied as a Ti-modified dispersant, such as a succinimide dispersant. Such materials may be prepared by forming a titanium mixed anhydride between a titanium alkoxide and a hydrocarbyl-substituted succinic anhydride, such as an alkenyl- (or alkyl) succinic anhydride. The resulting titanate-succinate intermediate may be used directly or it may be reacted with any of a number of materials, such as (a) a polyamine-based succinimide/amide dispersant having free, condensable —NH functionality; (b) the components of a polyamine-based succinimide/amide dispersant, i.e., an alkenyl- (or alkyl-) succinic anhydride and a polyamine, (c) a hydroxy-containing polyester dispersant prepared by the reaction of a substituted succinic anhydride with a polyol, aminoalcohol, polyamine, or mixtures thereof. Alternatively, the titanate-succinate intermediate may be reacted with other agents such as alcohols, aminoalcohols, ether alcohols, polyether alcohols or polyols, or fatty acids, and the product thereof either used directly to impart Ti to a lubricant, or else further reacted with the succinic dispersants as described above. As an example, 1 part (by mole) of tetraisopropyl titanate may be reacted with about 2 parts (by mole) of a polyisobutene-substituted succinic anhydride at 140-150° C. for 5 to 6 hours to provide a titanium modified dispersant or intermediate. The resulting material (30 g) may be further reacted with a succinimide dispersant from polyisobutene-substituted succinic anhydride and a polyethylenepolyamine mixture (127 grams+diluent oil) at 150° C. for 1.5 hours, to produce a titanium-modified succinimide dispersant.

Another titanium containing compound may be a reaction product of titanium alkoxide and $C_6$ to $C_{25}$ carboxylic acid. The reaction product may be represented by the following formula:

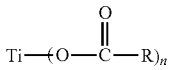

wherein n is an integer selected from 2, 3 and 4, and R is a hydrocarbyl group containing from about 5 to about 24 carbon atoms, or by the formula:

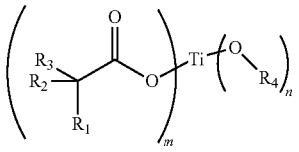

wherein m+n=4 and n ranges from 1 to 3, $R_4$ is an alkyl moiety with carbon atoms ranging from 1-8, $R_1$ is selected from a hydrocarbyl group containing from about 6 to 25 carbon atoms, and $R_2$ and $R_3$ are the same or different and are selected from a hydrocarbyl group containing from about 1 to 6 carbon atoms, or the titanium compound may be represented by the formula:

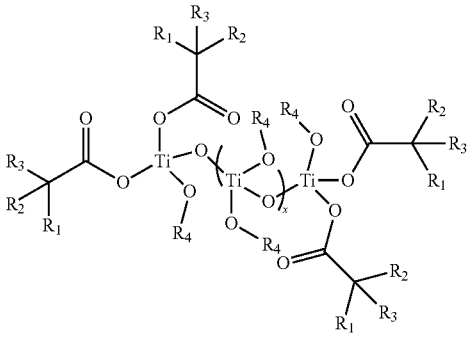

wherein x ranges from 0 to 3, $R_1$ is selected from a hydrocarbyl group containing from about 6 to 25 carbon atoms, $R_2$, and $R_3$ are the same or different and are selected from a hydrocarbyl group containing from about 1 to 6 carbon atoms, and $R_4$ is selected from a group consisting of either H, or $C_6$ to $C_{25}$ carboxylic acid moiety.

Suitable carboxylic acids may include, but are not limited to caproic acid, caprylic acid, lauric acid, myristic acid, palmitic acid, stearic acid, arachidic acid, oleic acid, erucic acid, linoleic acid, linolenic acid, cyclohexanecarboxylic acid, phenylacetic acid, benzoic acid, neodecanoic acid, and the like.

In an embodiment the oil soluble titanium compound may be present in the lubricating oil composition in an amount to provide from 0 to 3000 ppm titanium by weight or 25 to about 1500 ppm titanium by weight or about 35 ppm to 500 ppm titanium by weight or about 50 ppm to about 300 ppm.

Viscosity Index Improvers: The lubricating oil compositions herein also may optionally contain one or more viscosity index improvers. Suitable viscosity index improvers may include polyolefins, olefin copolymers, ethylene/propylene copolymers, polyisobutenes, hydrogenated styrene-isoprene polymers, styrene/maleic ester copolymers, hydrogenated styrene/butadiene copolymers, hydrogenated isoprene polymers, alpha-olefin maleic anhydride copolymers, polymethacrylates, polyacrylates, polyalkyl styrenes, hydrogenated alkenyl aryl conjugated diene copolymers, or mixtures thereof. Viscosity index improvers may include star polymers and suitable examples are described in US Publication No. 20120101017A1.

The lubricating oil compositions herein also may optionally contain one or more dispersant viscosity index improvers in addition to a viscosity index improver or in lieu of a viscosity index improver. Suitable viscosity index improvers may include functionalized polyolefins, for example, ethylene-propylene copolymers that have been functionalized with the reaction product of an acylating agent (such as maleic anhydride) and an amine; polymethacrylates functionalized with an amine, or esterified maleic anhydride-styrene copolymers reacted with an amine.

The total amount of viscosity index improver and/or dispersant viscosity index improver may be about 0 wt % to about 20 wt %, about 0.1 wt % to about 15 wt %, about 0.1 wt % to about 12 wt %, or about 0.5 wt % to about 10 wt %, of the lubricating oil composition.

Other Optional Additives: Other additives may be selected to perform one or more functions required of a lubricating fluid. Further, one or more of the mentioned additives may be multi-functional and provide functions in addition to or other than the function prescribed herein.

A lubricating oil composition according to the present disclosure may optionally comprise other performance additives. The other performance additives may be in addition to specified additives of the present disclosure and/or may comprise one or more of metal deactivators, viscosity index improvers, detergents, ashless TBN boosters, friction modifiers, antiwear agents, corrosion inhibitors, rust inhibitors, dispersants, dispersant viscosity index improvers, extreme pressure agents, antioxidants, foam inhibitors, demulsifiers, emulsifiers, pour point depressants, seal swelling agents and mixtures thereof. Typically, fully-formulated lubricating oil will contain one or more of these performance additives.

Suitable metal deactivators may include derivatives of benzotriazoles (typically tolyltriazole), dimercaptothiadiazole derivatives, 1,2,4-triazoles, benzimidazoles, 2-alkyldithiobenzimidazoles, or 2-alkyldithiobenzothiazoles; foam inhibitors including copolymers of ethyl acrylate and 2-ethylhexylacrylate and optionally vinyl acetate; demulsifiers including trialkyl phosphates, polyethylene glycols, polyethylene oxides, polypropylene oxides and (ethylene oxide-propylene oxide) polymers; pour point depressants including esters of maleic anhydride-styrene, polymethacrylates, polyacrylates or polyacrylamides.

Suitable foam inhibitors include silicon-based compounds, such as siloxane.

Suitable pour point depressants may include a polymethylmethacrylates or mixtures thereof. Pour point depressants may be present in an amount sufficient to provide from about 0 wt % to about 1 wt %, about 0.01 wt % to about 0.5 wt %, or about 0.02 wt % to about 0.04 wt % based upon the final weight of the lubricating oil composition.

Suitable rust inhibitors may be a single compound or a mixture of compounds having the property of inhibiting corrosion of ferrous metal surfaces. Non-limiting examples of rust inhibitors useful herein include oil-soluble high molecular weight organic acids, such as 2-ethylhexanoic acid, lauric acid, myristic acid, palmitic acid, oleic acid, linoleic acid, linolenic acid, behenic acid, and cerotic acid, as well as oil-soluble polycarboxylic acids including dimer and trimer acids, such as those produced from tall oil fatty acids, oleic acid, and linoleic acid. Other suitable corrosion inhibitors include long-chain alpha, omega-dicarboxylic acids in the molecular weight range of about 600 to about 3000 and alkenylsuccinic acids in which the alkenyl group contains about 10 or more carbon atoms such as, tetrapropenylsuccinic acid, tetradecenylsuccinic acid, and hexadecenylsuccinic acid. Another useful type of acidic corrosion inhibitors are the half esters of alkenyl succinic acids having about 8 to about 24 carbon atoms in the alkenyl group with alcohols such as the polyglycols. The corresponding half amides of such alkenyl succinic acids are also useful. A useful rust inhibitor is a high molecular weight organic acid. In some embodiments, an engine oil is devoid of a rust inhibitor.

The rust inhibitor, if present, can be used in an amount sufficient to provide about 0 wt % to about 5 wt %, about 0.01 wt % to about 3 wt %, about 0.1 wt % to about 2 wt %, based upon the final weight of the lubricating oil composition.

In general terms, a suitable crankcase lubricant may include additive components in the ranges listed in the following table.

TABLE 2

| Component | Wt. % (Suitable Embodiments) | Wt. % (Suitable Embodiments) |
|---|---|---|
| Polymeric Surfactants(s) | 0.01-3.0 | 0.025-1.0 |
| Dispersant(s) | 0.1-20.0 | 1.0-10.0 |
| Antioxidant(s) | 0.1-5.0 | 0.01-3.0 |
| Detergent(s) | 0.1-15.0 | 0.2-8.0 |
| Ashless TBN booster(s) | 0.0-1.0 | 0.01-0.5 |
| Corrosion inhibitor(s) | 0.0-5.0 | 0.0-2.0 |
| Metal dihydrocarbyldithiophosphate(s) | 0.1-6.0 | 0.1-4.0 |
| Ash-free phosphorus compound(s) | 0.0-6.0 | 0.0-4.0 |
| Antifoaming agent(s) | 0.0-5.0 | 0.001-0.15 |
| Antiwear agent(s) | 0.0-1.0 | 0.0-0.8 |
| Pour point depressant(s) | 0.0-5.0 | 0.01-1.5 |
| Viscosity index improver(s) (on a liquid/dilute basis) | 0.0-25.0 | 0.1-15.0 |
| Dispersant viscosity index improver(s) | 0.0-10.0 | 0.0-5.0 |
| Friction modifier(s) | 0.01-5.0 | 0.05-2.0 |
| Base oil(s) | Balance | Balance |
| Total | 100 | 100 |

The percentages of each component above represent the weight percent of each component, based upon the weight of the final lubricating oil composition. The remainder of the lubricating oil composition consists of one or more base oils. Additives used in formulating the compositions described herein may be blended into the base oil individually or in various sub-combinations. However, it may be suitable to blend all of the components concurrently using an additive concentrate (i.e., additives plus a diluent, such as a hydrocarbon solvent).

EXAMPLES

The following examples are illustrative of exemplary embodiments of the disclosure. In these examples, as well as elsewhere in this application, all ratios, parts, and percentages are by weight unless otherwise indicated. It is intended that these examples are being presented for the purpose of illustration only and are not intended to limit the scope of the invention disclosed herein.

Example 1

The following examples demonstrate the beneficial properties of copolymer surfactants and lubricating compositions of this disclosure. Tested formulations are listed in Table 3 below and polymeric surfactants evaluated in the fluids are shown in Table 4. The additive package and viscosity modifier are the same for all tested formulations. Base oil (Group III) treat rate was adjusted depending on the amount of co-polymers added.

For the testing, an emulsion was prepared by mixing each lubricating composition of Table 3, distilled water, and EEE gasoline at a weight ratio of 60:20:20 (total weight 100 g)

using a Waring blender at 17,000 rpm for 1 minute. EEE fuel is an unleaded fuel manufactured by Haltermann, as described in the E85 emulsion test (ASTMD7563). Then, the emulsion was transferred into a 100 mL measuring cylinder. The graduated cylinder was kept at room temperature for 3 hours. Samples for viscosity and flow point measurement were then taken from the 15 mL mark from the bottom of the graduated cylinder and measured using an Oscillatory rheometer.

Flow point was measured using an Anton Paar Oscillating MCR Rheometer by performing a strain sweep from 0.01 to 100% shear strain with a parallel plate spindle. The angular frequency in the test was 10 rad/s and the gap is set to 0.5 mm. After loading the sample to the plate on the rheometer, the system was cooled down to −30° C. and maintained at such temperature for 5 hours before the strain sweep starts. No further mixing was conducted on the samples before flow testing. The flow point is defined as the shear strain where G' (storage modulus) equals G" (loss modulus). A lower flow point suggests a sample having better flowability at testing conditions and temperature.

The flow points for all tested samples are listed in Table 3 and details on the polymeric surfactants are noted in Table 4. For instance, Comparable sample 1, without any polymeric surfactant, exhibited a very high flow point beyond the testing shear strain range (>100%) indicating the Sample remains a viscoelastic solid across the strain range measured. Inventive sample 2 that contains 0.3 wt % of a poly(meth)acrylate copolymer surfactant having pyrrolidone polar moieties (Co-polymer A) exhibited a low flow point around 1.4%. Inventive sample 3 that contains 0.3 wt % of a poly(meth)acrylate copolymer surfactant also including pyrrolidone but at a lower molecular weight (Co-polymer B) had a higher flow point than Inventive Sample 2, but is still acceptable and detectable in the testing range. These results indicate that inventive PMA copolymer surfactants with pyrrolidone polar functional groups in both Samples 2 and 3 can provide an emulsion of lubricant, water, and fuel good low temperature flowability at temperatures down to −30° C.

Example 4, 5, and 7 contain other types of polymeric surfactants with varying polar and nonpolar functionalities at the 0.3% test rate. The flow points of Samples 4 and 7 are lower than Sample 5 suggesting that higher molecular weight surfactants better provide emulsions at low temperatures (though the flow points of Sample 4 and 7 are comparable). Sample 6 with an olefin copolymer non-polar moiety and N-phenyl-phenylenediamine succinimide polar functionality can also achieve a good flow point at low temperatures. The results illustrate that the co-polymers of this disclosure surprisingly improve emulsion low temperature flowability.

TABLE 3

Samples and measured flow point for each formulation

| | 1 | 2 | 3 | 4 | 5 | 6 | 7 |
|---|---|---|---|---|---|---|---|
| Additive packages (wt %) | 10.1 | 10.1 | 10.1 | 10.1 | 10.1 | 10.1 | 10.1 |
| Viscosity modifier (wt %) | 5.5 | 5.5 | 5.5 | 5.5 | 5.5 | 5.5 | 5.5 |
| Surfactant (wt %) | 0 | 0.3 | 0.3 | 0.3 | 0.3 | 0.3 | 0.3 |
| Surfactant type | — | A | B | C | D | E | F |
| Base oil (wt %) | 84.4 | 84.1 | 84.1 | 84.1 | 84.1 | 84.1 | 84.1 |
| Total (wt %) | 100 | 100 | 100 | 100 | 100 | 100 | 100 |
| Measured flow point (%) | >100 | 1.51 | 71.2 | 21.6 | >100 | 45.0 | 24.3 |

TABLE 4

Surfactants used in the examples

| Surfactant | Mn | Mw | PDI | KV100 (cSt) | % active polymer | Polar group | Non-polar |
|---|---|---|---|---|---|---|---|
| A | | 450000 | | 1250 | 35 | N-vinyl pyrrolidone | PMA |
| B | | 214000 | | 1200 | 70 | N-vinyl pyrrolidone | PMA |
| C | 30000 | 49000 | 1.7 | 590 | 37 | dimethylaminopropyl methacrylamide | PMA |
| D | 17000 | 27000 | 1.6 | 740 | 75 | dimethylaminopropyl methacrylamide | PMA |
| E | 90000 | | | 1135 | 10 | N-phenyl-phenylenediamine succinamide | OCP |
| F | 126000 | 400000 | 3.17 | 850 | 33.8 | dimethylaminopropyl methacrylamide | PMA |

FIG. 1 also provides viscosity of the Samples and FIGS. 2-8 show the flow point determination.

It is noted that, as used in this specification and the appended claims, the singular forms "a," "an," and "the," include plural referents unless expressly and unequivocally limited to one referent. Thus, for example, reference to "an antioxidant" includes two or more different antioxidants. As used herein, the term "include" and its grammatical variants are intended to be non-limiting, such that recitation of items in a list is not to the exclusion of other like items that can be substituted or added to the listed items For the purposes of this specification and appended claims, unless otherwise indicated, all numbers expressing quantities, percentages or proportions, and other numerical values used in the specification and claims, are to be understood as being modified in all instances by the term "about." Accordingly, unless indicated to the contrary, the numerical parameters set forth in the following specification and attached claims are approximations that can vary depending upon the desired properties sought to be obtained by the present disclosure. At the very least, and not as an attempt to limit the application of the doctrine of equivalents to the scope of the claims, each numerical parameter should at least be construed in light of the number of reported significant digits and by applying ordinary rounding techniques.

It is to be understood that each component, compound, substituent or parameter disclosed herein is to be interpreted as being disclosed for use alone or in combination with one or more of each and every other component, compound, substituent or parameter disclosed herein.

It is further understood that each range disclosed herein is to be interpreted as a disclosure of each specific value within the disclosed range that has the same number of significant digits. Thus, for example, a range from 1 to 4 is to be interpreted as an express disclosure of the values 1, 2, 3 and 4 as well as any range of such values.

It is further understood that each lower limit of each range disclosed herein is to be interpreted as disclosed in combination with each upper limit of each range and each specific value within each range disclosed herein for the same component, compounds, substituent or parameter. Thus, this disclosure to be interpreted as a disclosure of all ranges derived by combining each lower limit of each range with each upper limit of each range or with each specific value within each range, or by combining each upper limit of each range with each specific value within each range. That is, it is also further understood that any range between the endpoint values within the broad range is also discussed herein. Thus, a range from 1 to 4 also means a range from 1 to 3, 1 to 2, 2 to 4, 2 to 3, and so forth.

Furthermore, specific amounts/values of a component, compound, substituent or parameter disclosed in the description or an example is to be interpreted as a disclosure of either a lower or an upper limit of a range and thus can be combined with any other lower or upper limit of a range or specific amount/value for the same component, compound, substituent or parameter disclosed elsewhere in the application to form a range for that component, compound, substituent or parameter.

While particular embodiments have been described, alternatives, modifications, variations, improvements, and substantial equivalents that are or can be presently unforeseen can arise to applicants or others skilled in the art. Accordingly, the appended claims as filed and as they can be amended are intended to embrace all such alternatives, modifications variations, improvements, and substantial equivalents.

What is claimed is:

1. A method for maintaining a fluid viscosity of a lubricating composition contaminated with water and/or fuel when measured at a temperature of about −30° C., the method comprising adding to a lubricating composition an additive including about 0.1 weight percent to about 0.4 weight percent of a polymeric surfactant with non-polar moieties and about 15 to about 30 weight percent of polar functional groups effective to maintain a fluid viscosity of the lubricating composition, water, and/or fuel as evidenced by a measured flow point of about 25% or less when the lubricating composition is mixed with water and/or fuel contamination and when measured at a temperature of about −30° C., and wherein the polymeric surfactant has a weight average molecular weight of about 40,000 to about 450,000 and wherein the polymeric surfactant is a copolymer obtained from reactants having ethylenic unsaturation and being functionalized either through grafting of polar groups or by incorporation of polar co-reactants in the polymerization and wherein the reactants having ethylenic unsaturation include alkyl (meth)acrylates having an alkyl chain length of 1 to 20 carbons providing the non-polar moieties and the polar functional groups include n-vinyl pyrrolidone or dimethylaminopropyl (meth)acrylamide, and wherein the polymeric surfactant has about 30 to about 40 weight percent active polymer and has a KV100 of about 500 to about 1300 cSt.

2. The method of claim 1, wherein the fuel is gasoline.

3. The method of claim 1, wherein the polar functional groups are pendant to a non-polar polymeric backbone.

4. The method of claim 1, wherein the lubricating composition is emulsified with water and fuel to maintain a fluid viscosity at temperatures down to about −30° C.

5. The method of claim 1, wherein the lubricating composition is an engine oil.

6. The method of claim 1, wherein the lubricating composition is a passenger car motor oil.

7. The method of claim 6, wherein the fuel is selected from the group consisting of gasoline, an alcohol-based fuel, and an alcohol-blended fuel.

8. The method of claim 1, wherein the fuel is an ethanol-blended gasoline.

9. The method of claim 1, wherein the fuel is selected from the group consisting of E10, E50, E85, and E100.

10. A method for maintaining a fluid viscosity of a lubricating composition contaminated with water and/or fuel when measured at a temperature of about −30° C., the method comprising adding to a lubricating composition an additive including about 0.1 weight percent to about 0.4 weight percent of a polymeric surfactant with non-polar moieties and about 15 to about 30 weight percent of polar functional groups effective to maintain a fluid viscosity of the lubricating composition, water, and/or fuel as evidenced by a measured flow point of about 25% or less when the lubricating composition is mixed with water and/or fuel contamination and when measured at a temperature of about −30° C., and wherein the polymeric surfactant has a weight average molecular weight of about 40,000 to about 450,000 and wherein the polymeric surfactant is a copolymer obtained from reactants having ethylenic unsaturation and being functionalized either through grafting of polar groups or by incorporation of polar co-reactants in the polymerization and wherein the reactants having ethylenic unsaturation include alkyl (meth)acrylates having an alkyl chain length of 12 to 20 carbons providing the non-polar moieties and the polar functional groups include n-vinyl pyrrolidone or dimethylaminopropyl (meth)acrylamide.

* * * * *